US012473679B2

(12) United States Patent
Sunaoshi

(10) Patent No.: US 12,473,679 B2
(45) Date of Patent: Nov. 18, 2025

(54) DYEING APPARATUS, DYEING UNIT, DYEING/EMBROIDERY SYSTEM, AND ADJUSTMENT METHOD IN DYEING APPARATUS

(71) Applicant: Masayuki Sunaoshi, Ibaraki (JP)

(72) Inventor: Masayuki Sunaoshi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 1087 days.

(21) Appl. No.: 17/449,117

(22) Filed: Sep. 28, 2021

(65) Prior Publication Data

US 2022/0098777 A1 Mar. 31, 2022

(30) Foreign Application Priority Data

Sep. 30, 2020 (JP) ..... 2020-166557
Aug. 13, 2021 (JP) ..... 2021-132074

(51) Int. Cl.

| | |
|---|---|
| ***D05C 11/24*** | (2006.01) |
| ***D05C 5/00*** | (2006.01) |
| *D06P 1/00* | (2006.01) |
| *D06P 5/30* | (2006.01) |

(52) U.S. Cl.

CPC ..... *D05C 11/24* (2013.01); *D05C 5/00* (2013.01); *D06P 1/0032* (2013.01); *D06P 5/30* (2013.01)

(58) Field of Classification Search

CPC . D05C 11/24; D05C 5/00; D05C 5/02; D05B 19/12

See application file for complete search history.

(56) References Cited

U.S. PATENT DOCUMENTS

| | | | | |
|---|---|---|---|---|
| 4,465,005 | A * | 8/1984 | Eguchi | D06B 11/0026 112/270 |
| 6,189,989 | B1 * | 2/2001 | Hirabayashi | D05C 11/24 427/288 |
| 10,723,158 | B2 | 7/2020 | Toda et al. | |
| 10,974,522 | B2 | 4/2021 | Ikegami | |
| 2016/0009113 | A1 | 1/2016 | Uetake | |
| 2018/0171520 | A1 * | 6/2018 | Eklind | D05C 11/24 |
| 2020/0171846 | A1 | 6/2020 | Hayashi et al. | |
| 2020/0171854 | A1 | 6/2020 | Sunaoshi et al. | |
| 2021/0023837 | A1 | 1/2021 | Nagasu et al. | |

FOREIGN PATENT DOCUMENTS

| | | |
|---|---|---|
| JP | H05-025519 | 4/1993 |
| JP | 2008-289521 | 12/2008 |
| JP | 2009-273675 | 11/2009 |
| JP | 2014-195994 | 10/2014 |

* cited by examiner

*Primary Examiner* — Nathan E Durham
(74) *Attorney, Agent, or Firm* — IPUSA, PLLC

(57) ABSTRACT

A dyeing apparatus is configured to be connected to an embroidery apparatus. The dyeing apparatus includes a dyer configured to dye a thread; a conveying path in which a path length of the thread from the dyer to the embroidery apparatus is changed according to an operation of the embroidery apparatus; and a conveyance control unit configured to adjust a conveyance speed of the thread in the conveying path, according to a change in the path length. The dyer dyes the thread at a dyeing speed that matches the adjusted conveyance speed.

9 Claims, 17 Drawing Sheets

FIG.9

| No. | ITEM | FIRST DETEC-TION | COR-RECTED VALUE | SECOND DETEC-TION | COR-RECTED VALUE | THIRD DETEC-TION | COR-RECTED VALUE | FOURTH DETEC-TION | COR-RECTED VALUE | FIFTH DETEC-TION | COR-RECTED VALUE | SIXTH DETEC-TION |
|---|---|---|---|---|---|---|---|---|---|---|---|---|
| 1 | CONVEYANCE THREAD LENGTH (DYE DATA CONSUMPTION AMOUNT_SETTING VALUE) | 10 | | 10 | | 10 | | 10 | | 10 | | 10 |
| 2 | TIME REQUIRED FOR CONVEYING PREDETERMINED LENGTH (SETTING VALUE) | 10 | | 12 | | 8 | | 10 | | 8 | | 12 |
| 3 | TIME REQUIRED FOR CONVEYING PREDETERMINED LENGTH (AFTER CORRECTION) | 10 | | 11.510204 | | 8 | | 10.294118 | | 7.9230769 | | 12.244898 |
| 4 | DYE DATA CONSUMPTION AMOUNT_AFTER CORRECTION | 10 | | 8.9 | | 10 | | 10.5 | | 9.9 | | 10.1 |
| 5 | NEEDLE THREAD CONVEYANCE TIME CORRECTION VALUE | | -0.489796 | | 0 | | 0.2941179 | | -0.076923 | | 0.244898 | |
| 6 | DEVIATION AMOUNT OF PATH LENGTH FROM INITIAL VALUE | -0.2 | | -0.1 | | 0.1 | | 0 | | 0.1 | | 0.2 |
| 7 | VARIATION AMOUNT OF PATH LENGTH FROM PREVIOUS LENGTH (DANCER ROLLER POSITION) | -0.2 | | 0.1 | | 0.2 | | -0.1 | | 0.1 | | 0.1 |
| 8 | DYE DATA CORRECTION VALUE | | 1.1 | | 0 | | -0.5 | | 0.1 | | -0.1 | |
| 9 | NEEDLE THREAD CONSUMPTION AMOUNT AT EMBROIDERY MACHINE (INITIAL SETTING VALUE) | 10 | | 10 | | 10 | | 10 | | 10 | | 10 |
| 10 | ASSUMED NEEDLE THREAD CONSUMPTION AMOUNT AT EMBROIDERY APPARATUS AFTER TIME CORRECTION | 10 | | 9 | | 10 | | 10.5 | | 9.7 | | 10.1 |
| 11 | DEVIATION OF CONSUMED EMBROIDERY DATA LENGTH FROM ASSUMED VALUE | -0.1 | | 0 | | 0 | | 0.2 | | 0 | | 0 |

ACCUMULATED CORRECTION

| | | | | | | | | | | | |
|---|---|---|---|---|---|---|---|---|---|---|---|
| DYE MACHINE SIDE_ACCUMULATED DYE DATA | 10 | | 18.9 | | 28.9 | | 39.4 | | 49.3 | | 59.4 |
| EMBROIDERY MACHINE SIDE_ACCUMULATED DYE DATA | 9.9 | | 18.9 | | 28.9 | | 39.6 | | 49.3 | | 59.4 |

FIG.14

| No. | ITEM | FIRST DETEC-TION | COR-RECTED VALUE | SECOND DETEC-TION | COR-RECTED VALUE | THIRD DETEC-TION | COR-RECTED VALUE | FOURTH DETEC-TION | COR-RECTED VALUE | FIFTH DETEC-TION | COR-RECTED VALUE | SIXTH DETEC-TION |
|---|---|---|---|---|---|---|---|---|---|---|---|---|
| 1 | DEFINED TIME (SETTING VALUE) | 10 | | 10 | | 10 | | 10 | | 10 | | 10 |
| 2 | CONVEYED THREAD LENGTH_SETTING VALUE | 10 | | 9 | | 9 | | 11 | | 11 | | 10 |
| 3 | CONVEYED THREAD LENGTH_AFTER CORRECTION | 10 | | 9.4 | | 9 | | 10.7 | | 11.1 | | 10.2 |
| 4 | DYE DATA CONSUMPTION AMOUNT_AFTER CORRECTION | 10 | | 8.9 | | 9 | | 11 | | 11.2 | | 10 |
| 5 | THREAD CONVEYANCE LENGTH CORRECTION VALUE | | -0.4 | | 0 | | 0.3 | | -0.1 | | 0.2 | |
| 6 | DEVIATION AMOUNT OF PATH LENGTH FROM INITIAL VALUE | -0.2 | | -0.1 | | 0.1 | | 0 | | 0.1 | | 0.2 |
| 7 | VARIATION AMOUNT OF PATH LENGTH FROM PREVIOUS LENGTH (DANCER ROLLER POSITION) | -0.2 | | 0.1 | | 0.2 | | -0.1 | | 0.1 | | 0.1 |
| 8 | DYE DATA CORRECTION VALUE | | 0.5 | | 0 | | -0.3 | | 0.1 | | 0.2 | |
| 9 | NEEDLE THREAD CONSUMPTION AMOUNT AT EMBROIDERY MACHINE (INITIAL SETTING VALUE) | 10 | | 9 | | 9 | | 11 | | 11 | | 10 |
| 10 | ASSUMED NEEDLE THREAD CONSUMPTION AMOUNT AT EMBROIDERY APPARATUS AFTER LENGTH CORRECTION | 10 | | 9 | | 9 | | 11 | | 11 | | 10 |
| 11 | DEVIATION OF CONSUMED EMBROIDERY DATA LENGTH FROM ASSUMED VALUE | -0.1 | | 0 | | 0 | | 0.2 | | 0 | | 0 |

| | | | | | | | | | | | |
|---|---|---|---|---|---|---|---|---|---|---|---|
| DYE MACHINE SIDE_ACCUMULATED DYE DATA | 10 | | 18.9 | | 27.9 | | 38.9 | | 50.1 | | 60.1 |
| EMBROIDERY MACHINE SIDE_ACCUMULATED DYE DATA | 9.9 | | 18.9 | | 27.9 | | 39.1 | | 50.1 | | 60.1 |

DYEING APPARATUS, DYEING UNIT, DYEING/EMBROIDERY SYSTEM, AND ADJUSTMENT METHOD IN DYEING APPARATUS

CROSS-REFERENCE TO RELATED APPLICATION

The present application is based on and claims priority under 35 U.S.C. § 119 to Japanese Patent Application No. 2020-166557, filed on Sep. 30, 2020, and Japanese Patent Application No. 2021-132074, filed on Aug. 13, 2021, the contents of which are incorporated herein by reference in their entirety.

BACKGROUND OF THE INVENTION

1. Field of the Invention

The present invention relates to a dyeing apparatus, a dyeing unit, a dyeing/embroidery system, and an adjustment method in a dyeing apparatus.

2. Description of the Related Art

Automatic embroidery apparatuses for business purposes are already commercialized and in widespread use; however, the conventional automatic embroidery apparatuses are required to be large-sized embroidery apparatuses that hold needle threads (upper threads) of multiple colors, because when multiple colors are embroidered, it is necessary to create embroidery pattern information for each color and replace the needle thread according to the specified color. When embroidery using continuous color tone changes (gradation) is carried out with such an apparatus, the needle threads are to be prepared according to a number of slightly different colors and embroidery is performed while sequentially changing the needle threads. Therefore, there has been a limit to the colors of the needle threads, and a variety of expressions of the embroidery has been limited.

Thus, in recent years, there is known a system in which the ink-jet technology is used for dyeing a needle thread so as to apply colors that vary in the conveying direction, and embroidery is performed with the dyed needle threads by using an embroidery machine or a sewing machine.

Patent Document 1 proposes a technique used in an apparatus including a dyeing unit and an embroidery unit. This technique involves storing a dyed thread having a sufficient length in a thread pool and keeping the dyed thread in a standby state in front of the embroidery unit, as a measure for addressing a situation where the conveyance speed of the dyeing unit provided on the upstream side of the embroidery unit slows down with respect to the varying embroidery speed in the embroidery unit.

Patent Document 1: Japanese Unexamined Patent Application Publication No. 2009-273675

SUMMARY OF THE INVENTION

According to one aspect of the present invention, there is provided a dyeing apparatus configured to be connected to an embroidery apparatus, the dyeing apparatus including a dyer configured to dye a thread; a conveying path in which a path length of the thread from the dyer to the embroidery apparatus is changed according to an operation of the embroidery apparatus; and a conveyance control unit configured to adjust a conveyance speed of the thread in the conveying path, according to a change in the path length, wherein the dyer dyes the thread at a dyeing speed that matches the adjusted conveyance speed.

BRIEF DESCRIPTION OF THE DRAWINGS

FIG. 9 is a table illustrating a specific example of control along the flow in FIG. 8;

FIG. 14 is a table illustrating a specific example of control along the flow of FIG. 13;

DESCRIPTION OF THE EMBODIMENTS

Figure 1:
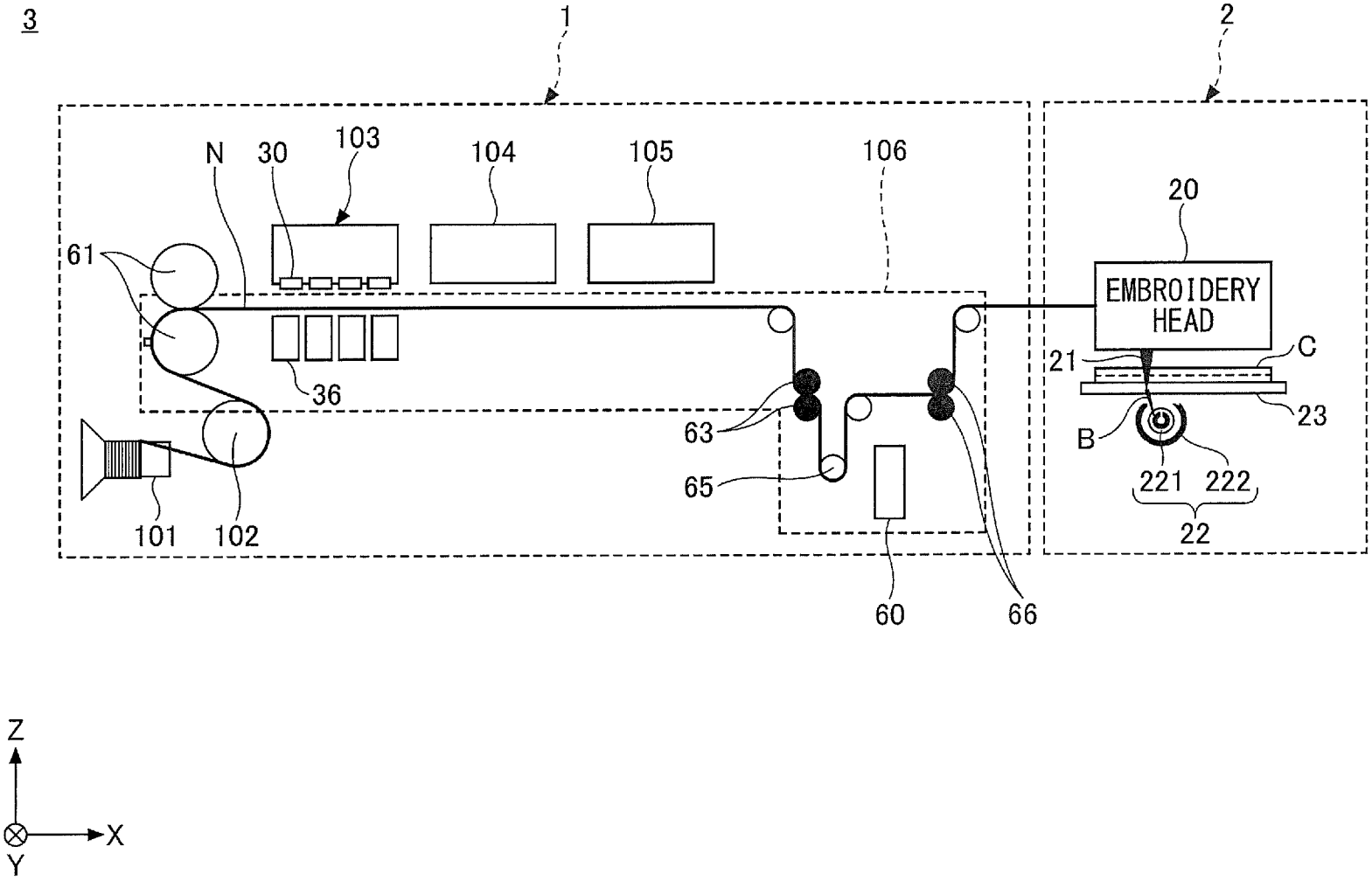
FIG. 1 is an exemplary schematic side view of a dyeing/embroidery system including a dyeing apparatus and an embroidery apparatus according to a first embodiment of the present invention.

In Patent Document 1, the difference in the speed of the needle thread and the bobbin thread (lower thread) can be eliminated by storing the dyed needle thread in a thread pool in front of the embroidery unit and extending the path length. However, the position of the color of the needle thread in the embroidery unit will be deviated, and, therefore, the color of the dyed needle thread is detected by a color detecting unit immediately before the embroidery unit, and the needle thread that is unnecessary is wound onto a winding device so that the desired needle thread is brought to the proper position in the embroidery pattern. Accordingly, in Patent Document 1, a thread pool and a winding device are required to align the position of the needle thread, and the apparatus has become more complicated and larger.

A problem to be addressed by an embodiment of the present invention is to provide a dyeing apparatus that can reduce the positional deviation of the color of the needle thread while eliminating the difference in the speed between the needle thread and the bobbin thread in the embroidery apparatus without increasing the size of the apparatus, when using a continuous needle thread having varied colors in the embroidery apparatus connected to the dyeing apparatus.

Hereinafter, an embodiment for carrying out the present invention will be described with reference to the drawings. In the following drawings, the same elements are denoted by the same reference numerals, and overlapping descriptions may be omitted.

First Embodiment

<Overall Configuration>

Figure 2:
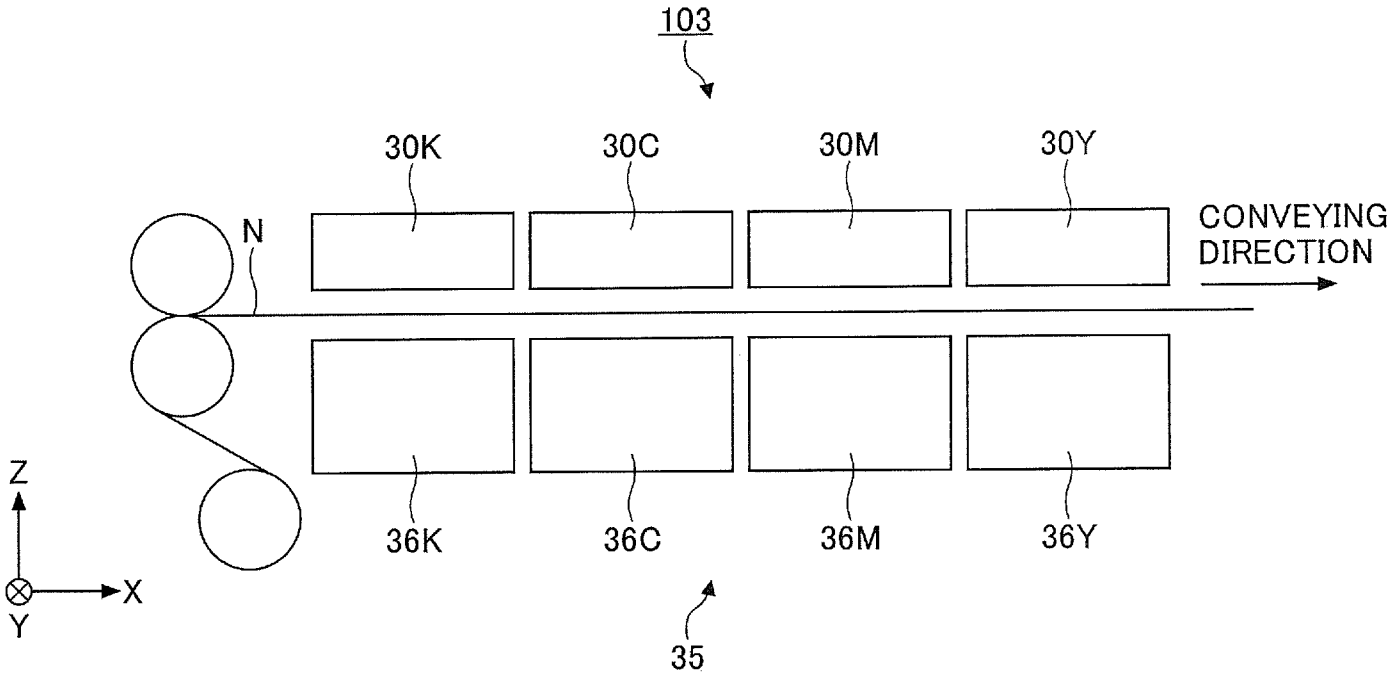
FIG. 2 is a schematic side view of a dyeing unit of a dyeing apparatus according to the first embodiment of the present invention.
Figure 3:
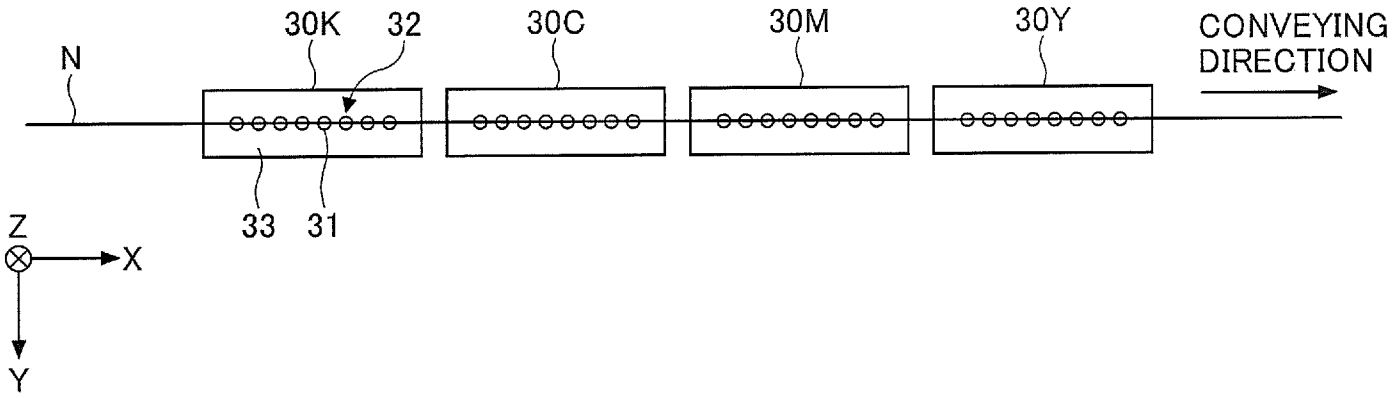
FIG. 3 is a schematic bottom view of a dyeing unit according to the first embodiment of the present invention.

First, a dyeing/embroidery apparatus including the dyeing apparatus according to a first embodiment of the present invention will be described with reference to FIGS. 1 to 3. FIG. 1 is a schematic side view illustrating an example of a dyeing/embroidery system including the dyeing apparatus according to the first embodiment of the present invention and an embroidery apparatus. FIG. 2 is a schematic side view of a dyeing unit in the dyeing apparatus according to one embodiment of the present invention. FIG. 3 is a schematic bottom view of the dyeing unit according to one embodiment of the present invention.

Referring to FIG. 1, a dyeing/embroidery system 3 according to the present embodiment includes a dyeing apparatus 1 and an embroidery apparatus 2. In the present system, the dyeing apparatus 1 is electrically connected to the embroidery apparatus 2 by wire or wireless communication for exchanging information.

The dyeing apparatus 1 includes a needle thread reel 101 around which a needle thread N (upper thread) is wound, a dyeing unit 103, a fixing unit 104, and a post-processing unit 105. The dyeing apparatus 1 according to the present embodiment is a thread coloring apparatus that dyes a thread by a liquid discharging method.

In the dyeing apparatus 1, the needle thread N drawn from the needle thread reel 101 is guided by a path length variable conveying unit 106 including a roller 102 and nip rollers 61, 63, and 66, and is continuously extended around the rollers so as to reach an embroidery head 20 of the embroidery apparatus 2.

The path length variable conveying unit 106, which is capable of adjusting the conveying path length (thread conveying path length) of the needle thread N in the dyeing apparatus 1, includes a variable conveying path PL (see FIG. 4) including a dancer roller 65 which moves up and down and which is provided immediately before the embroidery apparatus 2, a driving unit driving the nip rollers 61 and 63 of the variable conveying path PL, and a position detection sensor 60. Details of the path length variable conveying unit 106 will be described later with reference to FIG. 4.

The dyeing unit 103 includes a maintenance/discharge unit 35 including a plurality of discharge heads 30 (30K to 30Y) for discharging and applying the liquid of the required color to the needle thread N that is drawn out and conveyed from the needle thread reel 101, and a plurality of individual maintenance units 36 (36K to 36Y) for performing maintenance of each of the discharge heads 30K to 30Y.

Hereinafter, the direction of conveying the needle thread when passing through the dyeing unit 103 is referred to as X, the direction of the depth of the dyeing/embroidery system 3 (the width direction of the needle thread) is referred to as Y, and the direction of the height (the vertical direction) is referred to as Z.

Referring to FIG. 2, the plurality of discharge heads 30K to 30Y are liquid applying means, respectively, and are discharge heads (dyeing heads) that discharge liquid of different colors from each other. For example, the discharge head 30K is the head that discharges droplets (ink) of black (K), the discharge head 30C is the head that discharges droplets of cyan (C), the discharge head 30M is the head that discharges droplets of magenta (M), and the discharge head 30Y is the head that discharges droplets of yellow (Y). The order of the colors illustrated in FIG. 2 is an example and the colors may be arranged in a different order from this description. Although not illustrated, the dyeing unit 103 may include a discharge head for discharging colorless droplets to coat the dyed thread, at the most downstream position.

Further, the maintenance units 36K to 36Y are provided at the lower side of the discharge heads 30K to 30Y of each color. As maintenance and recovery operations, a head that is not in use is capped, droplets are idly discharged from the discharge head 30, a nozzle suction and circulation operation is performed in a state where an idle discharge receiver is brought close to the head, and a nozzle wiping operation, are performed.

Here, as illustrated in FIG. 3, each of the discharge heads 30K to 30Y has a nozzle surface 33 on which a nozzle array 32, having a plurality of nozzles 31 arranged to discharge droplets, is formed. Each of the discharge heads 30 is arranged such that the direction of the nozzle array 32, which is an array of the nozzles 31, is in the conveying direction of the needle thread N. In FIG. 3, only one nozzle array 32 is illustrated on the nozzle surface 33. However, a plurality of the nozzle arrays 32 may be arranged on the nozzle surface 33.

Referring back to FIG. 1, the fixing unit 104 performs a fixing process (a drying process) of fixing the liquid discharged from the dyeing unit 103, to the needle thread N onto which the liquid is applied. The fixing unit 104 includes a heating means such as an infrared irradiation means and a hot air blowing means, for example, and heats the needle thread N to dry.

The post-processing unit 105 includes, for example, a cleaning means for cleaning the needle thread N, a lubricant applying means for applying a lubricant to the surface of the needle thread N, and the like.

Further, in the dyeing apparatus 1 according to an embodiment of the present invention, at least the dyeing unit 103 for applying a colored liquid to the needle thread N is to be provided, and the fixing unit 104 and a post-processing unit 105 may not be provided.

The dyeing unit 103 of the dyeing apparatus 1 illustrated in FIGS. 1 to 3 is illustrated as having a configuration example of a liquid discharge method in which the needle thread N is dyed by discharging ink from the discharge heads 30Y to 30K. However, the dyeing unit 103 may be a dyeing unit of a coating method in which ink is applied by sandwiching the needle thread N with a roller or the like.

The embroidery apparatus 2 illustrated in FIG. 1 includes a needle 21, a bobbin thread rotation body 22, a stage 23, and the embroidery head 20. The needle 21 has a needle hole at the tip of the needle through which the needle thread N passes, and is movable in a vertical direction with respect to a cloth C.

The bobbin thread rotation body 22 has a bobbin thread bobbin 221 around which a bobbin thread B (lower thread) is wound, and a hook 222, and the bobbin thread bobbin 221 and the hook 222 rotate in conjunction with movement of the needle 21. Although not illustrated, the bobbin thread rotation body 22 is also provided with a cylindrical shuttle body for accommodating the bobbin thread bobbin 221, an outer hook on a cylinder with a base, and a cylindrical case integral with the hook 222. In FIG. 1, the bobbin thread bobbin 221 is an example of a vertical rotation method in which the rotation direction is the vertical direction (vertical full rotation shuttle method, vertical half rotation shuttle method); however, the bobbin thread bobbin 221 may be of a horizontal rotation method in which the rotation direction is the horizontal direction (horizontal shuttle method).

The stage 23 is a base for holding the cloth C, and a hole (not illustrated) through which a needle passes is formed. The stage 23 can be moved in the X and Y directions for feeding the cloth.

Figure 5:
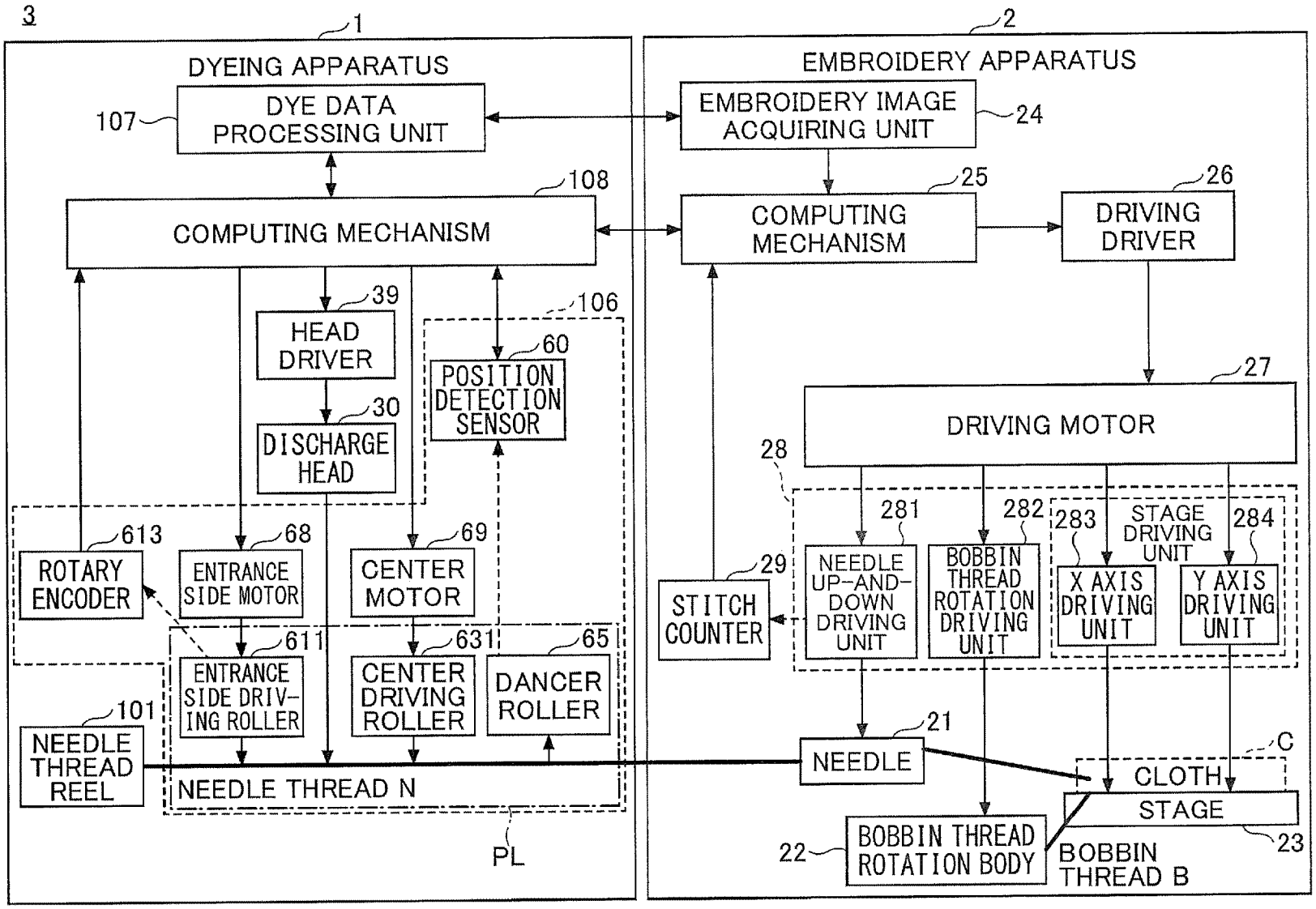
FIG. 5 is a schematic block diagram of a dyeing/embroidery system according to the first embodiment of the present invention.

The embroidery head 20 is provided with a computing mechanism 25 (see FIG. 5). The computing mechanism 25 controls the movement of the needle 21 through which the needle thread N passes (the needle movement) and the movement of the stage 23. Accordingly, an embroidery pattern (the embroidery design) is formed on the cloth C by performing embroidery on the cloth C using the needle thread N and the bobbin thread B fed in accordance with the feed of the needle thread N in the embroidery apparatus 2.

Further, the "thread" may be a fiberglass thread, a woolen thread, a cotton thread, a synthetic thread, a metal thread, wool, cotton, a polymer, or mixed metal threads, yarn, filaments, or any linear member (continuous base material) to which liquid can be applied, including braids, straps, and the like.

(Conveying Path)

Figure 4:
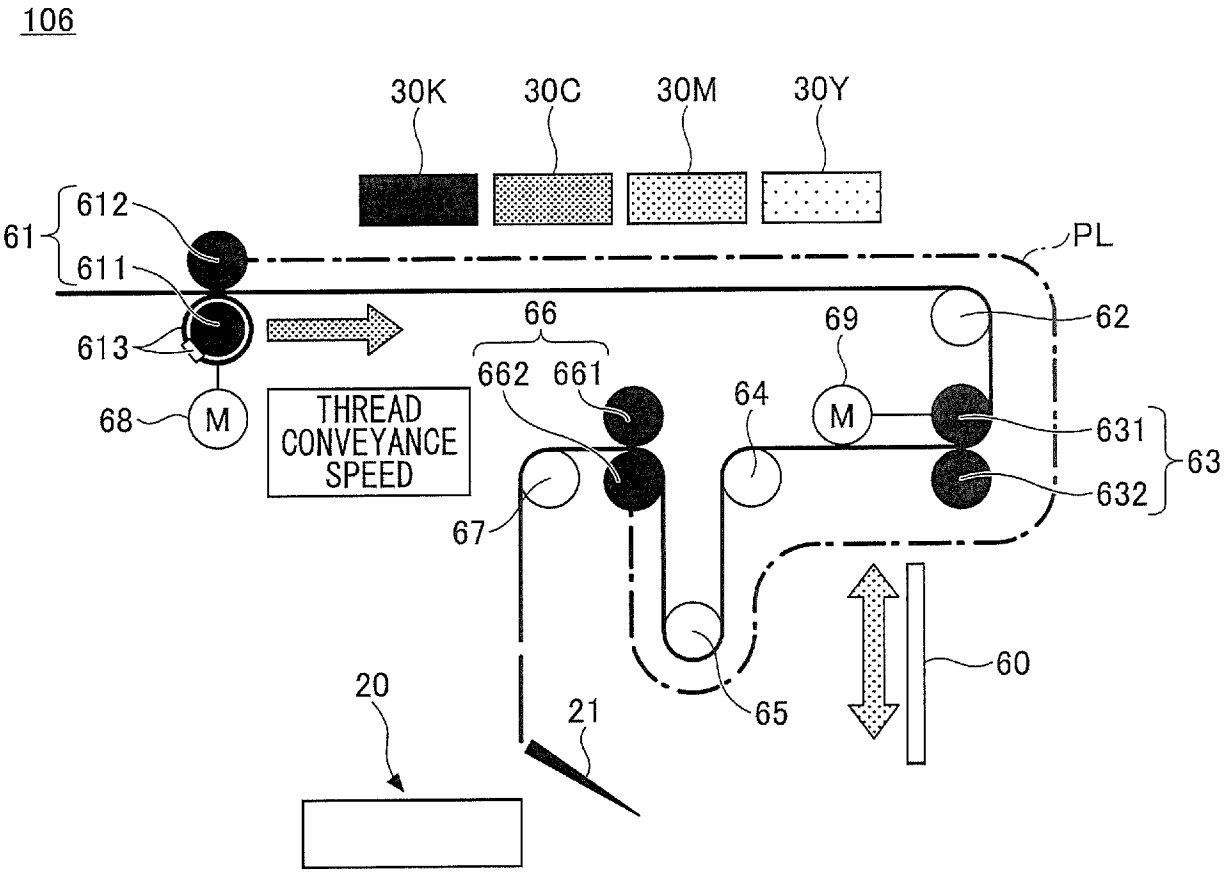
FIG. 4 is a schematic diagram of a path length variable conveying unit of the dyeing apparatus according to the first embodiment of the present invention.

FIG. 4 is a schematic illustration of the path length variable conveying unit 106 in the dyeing apparatus of one embodiment of the present invention. FIG. 4 schematically illustrates the path length variable conveying unit 106 having a path different from that illustrated in FIG. 1, in a case where the dyeing apparatus 1 is disposed on the upper side of the embroidery apparatus 2.

The variable conveying path PL of the path length variable conveying unit 106 includes an inlet nip roller 61, a conveying roller 62, a center nip roller 63, a conveying roller 64, a dancer roller 65, and an outlet nip roller 66.

The inlet and outlet of the variable conveying path PL are sandwiched by the nip rollers 61 and 66 with pressure applied, forming a closed conveying path system. A conveying roller 67 is a roller outside the variable conveying path PL.

In the variable conveying path PL, the dancer roller 65 disposed near the upstream side of the outlet nip roller 66 at the outlet side can be moved up and down (raised and lowered vertically). As the dancer roller 65 moves up and down, the overall length of the path length of the variable conveying path PL is changed.

In the path length variable conveying unit 106, the position detecting sensor 60, which is configured by, for example, a linear encoder, is provided near the dancer roller 65. The position detecting sensor 60 is an example of the position detecting means and detects the position of the dancer roller 65. Accordingly, the amount of path buffer according to the dancer roller 65 can be identified, and the path length can be calculated.

The inlet side nip roller 61 is provided upstream of the dyeing unit 103 in the conveying direction to be the upstream end of the variable conveying path PL. The inlet side nip roller 61 is configured to sandwich the needle thread N between a driving roller 611 and a nip roller 612. The driving roller 611 is provided with a rotary encoder 613 for detecting the conveying length of the needle thread in the dyeing apparatus 1. An inlet motor 68, which is a driving motor, is connected to the driving roller 611. The inlet motor 68 is driven to rotate the driving roller 611 at a conveyance speed instructed from the computing mechanism 108 (see FIG. 5).

The center nip roller 63 is configured to sandwich the needle thread N between a center driving roller 631 and a nip roller 632. A center motor 69, which is a driving motor, is connected to the center driving roller 631. The center motor 69 is driven to rotate the center driving roller 631 at a conveyance speed instructed from the computing mechanism 108 (see FIG. 5). The inlet motor 68 and the center motor 69 are driving units of the path length variable conveying unit 106 for conveying the needle thread.

The center driving roller 631, which is driven by the center motor 69, rotates at a speed slightly faster than the inlet side, so that it is possible to convey an object between the inlet side nip roller 61 and the center nip roller 63 without any slack.

The outlet nip roller 66 is provided near the embroidery apparatus 2, to be a downstream end of the variable conveying path PL. The outlet nip roller 66 includes two rollers 661 and 662 forming a pair, that sandwich the needle thread N, and is not provided with a driving force. Therefore, the outlet nip roller 66 carries the needle thread N in a manner as to be pulled by the embroidery apparatus 2, according to the amount consumed by the embroidery apparatus 2.

In the variable conveying path PL having such a configuration, the dancer roller 65 moves up and down in response to the pulling force from the embroidery apparatus 2. Therefore, the difference between the cumulative thread consumption amount of the embroidery apparatus 2 and the cumulative amount of the needle thread N conveyed by the inlet nip roller 61, corresponds to a change in the path length. Accordingly, in the conveyance from the dyeing unit 103 to the embroidery apparatus 2, the tensile change of the needle thread, such as the slack or pull of the needle thread immediately before the embroidery apparatus 2, does not accumulate.

In an embodiment of the present invention, on the assumption that the path length varies in the variable conveying path PL according to the operation of the embroidery apparatus 2, the conveyance speed of the thread in the variable conveying path PL is adjusted, and further, the data length of the next dye data in the dyeing apparatus 1 is corrected. Therefore, by changing the conveying path length and adjusting the conveyance speed, it is possible to adjust the position of a color boundary in the needle thread by adjusting the dye data length while keeping the tension of the needle thread supplied to the side of the embroidery apparatus 2 constant, thereby preventing the deviation of the embroidery position and the dyeing position in the embroidery apparatus 2.

(Schematic Block)

FIG. 5 is a schematic block diagram of the dyeing/embroidery system according to the first embodiment.

As illustrated in FIG. 5, the dyeing apparatus 1 includes a dye data processing unit 107, the computing mechanism 108, and a head driver 39 in addition to the configuration according to FIG. 1.

The dye data processing unit 107 is a control unit for generating and editing dye data and is configured by an information processing apparatus (computer), for example, a central processing unit (CPU), a field programmable gate array (FPGA), and an application specific integrated circuit (ASIC).

The computing mechanism 108 is a main control unit of the dyeing apparatus 1 and is configured by an information processing apparatus (computer), for example, a CPU. The function of the dye data processing unit 107 and a part of the function of the computing mechanism 108 may not be provided in the dyeing apparatus, and control in this case will be described later with reference to FIGS. 16 and 17 as a third embodiment.

The head driver 39 drives the discharge heads 30Y to 30K to discharge ink drops from the nozzle so as to dye the thread according to a set dyeing length based on the dye data output from the computing mechanism 108.

The embroidery apparatus 2 includes an embroidery image acquiring unit 24, the computing mechanism 25, a driving driver 26, a driving motor 27, a needle up-and-down driving unit 281, a bobbin thread rotation driving unit 282, an X axis driving unit 283, a Y axis driving unit 284, and a stitch counter 29 as a part related to the drive control.

For example, the embroidery image acquiring unit 24 is a communication unit for communicating with an external device, and acquires the embroidery image (embroidery file) that is the source of the embroidery data, and outputs the image to the computing mechanism 25. Alternatively, the embroidery image acquiring unit 24 may be an operation panel or the like, and in the case of an operation panel, the embroidery image is directly input by an operator's operation.

The computing mechanism 25 creates embroidery data based on the embroidery image and outputs the embroidery data to a driving driver 26. Further, the computing mechanism 25 calculates the thread consumption amount based on the embroidery data and the progress (stitch data) of the number of stitches progressed detected by the stitch counter 29, and outputs the result to the computing mechanism 108 of the dyeing apparatus 1.

Here, the embroidery image is the image data (image information, embroidery design data) that is the original draft of the embroidery pattern to be applied onto the cloth. In the present embodiment, the computing mechanism 25 decomposes the embroidery image into each of the specific colors (RGB values) and creates embroidery data so as to determine the thread color to be used and the continuous length of each color on the thread so as to smoothly perform the sewing in the sequential order of colors, based on the size of the embroidery pattern on the cloth, and to form stitches on the cloth using the determined thread color.

Here, embroidery data is "data that combines data of the coordinates to which the needle is to be moved and the operation to be implemented at the coordinates". Specifically, the operation to be implemented at the coordinates are as follows, for example, among other operations.

(1) Insert the needle into the cloth to intertwine with the bobbin thread, return the needle to the front side of the cloth, and then move the needle to the position where the needle is to be inserted next.

(2) End or interrupt the embroidery (including switching to another needle, cutting the thread to move to another position where the embroidery is not continued).

(3) Move to the initialization position (alignment position).

Further, as embroidery data files, formats such as ".dst", ".pes" or the like are commonly known.

The driving driver 26 controls the driving motor 27 on the basis of embroidery data.

The needle up-and-down driving unit 281, referred to as a needle thread take up, drives the vertical movement of the needle 21 through which the needle thread N is passed, by converting the rotational movement of the upper shaft coupled to the driving motor 27 into a vertical movement.

The bobbin thread rotation driving unit 282 rotates the bobbin thread rotation body 22 in conjunction with the vertical movement of the needle 21 by the rotational movement of a lower shaft coupled to the upper shaft via a belt cam crank.

The X axis driving unit 283 and the Y axis driving unit 284 are stage movement driving units (cloth feeding units) that drive the X direction and Y direction movement of the stage 23 on which the cloth C is mounted in conjunction with the vertical movement of the needle 21 and the rotation of the bobbin thread rotation body 22 by the rotation of the lower axis. In this case, as a method of feeding the cloth C, the entire stage 23 may be moved, or the feed teeth provided in the holes formed in the stage 23 may be moved.

The needle up-and-down driving unit 281, the bobbin thread rotation driving unit 282, the X axis driving unit 283, and the Y axis driving unit 284 form a driving mechanism 28 driven in conjunction with one driving motor 27. Therefore, the rotation of the driving motor 27 causes the vertical movement of the needle 21, the rotation movement of the bobbin thread rotation body 22, and the XY movement of the cloth C on the stage 23. For example, one up and down movement of the needle 21 is associated with one or an integral number of rotation movements of the bobbin thread rotation body 22.

The stitch counter 29 is a sensor for detecting the vertical movement of the needle 21, e.g., mounted on a needle bar holding the needle 21, and detects the number of stitches corresponding to how many times the needle 21 has been raised and lowered, i.e., how many stitches have progressed.

(Control Block for Dye/Conveyance)

Figure 6:
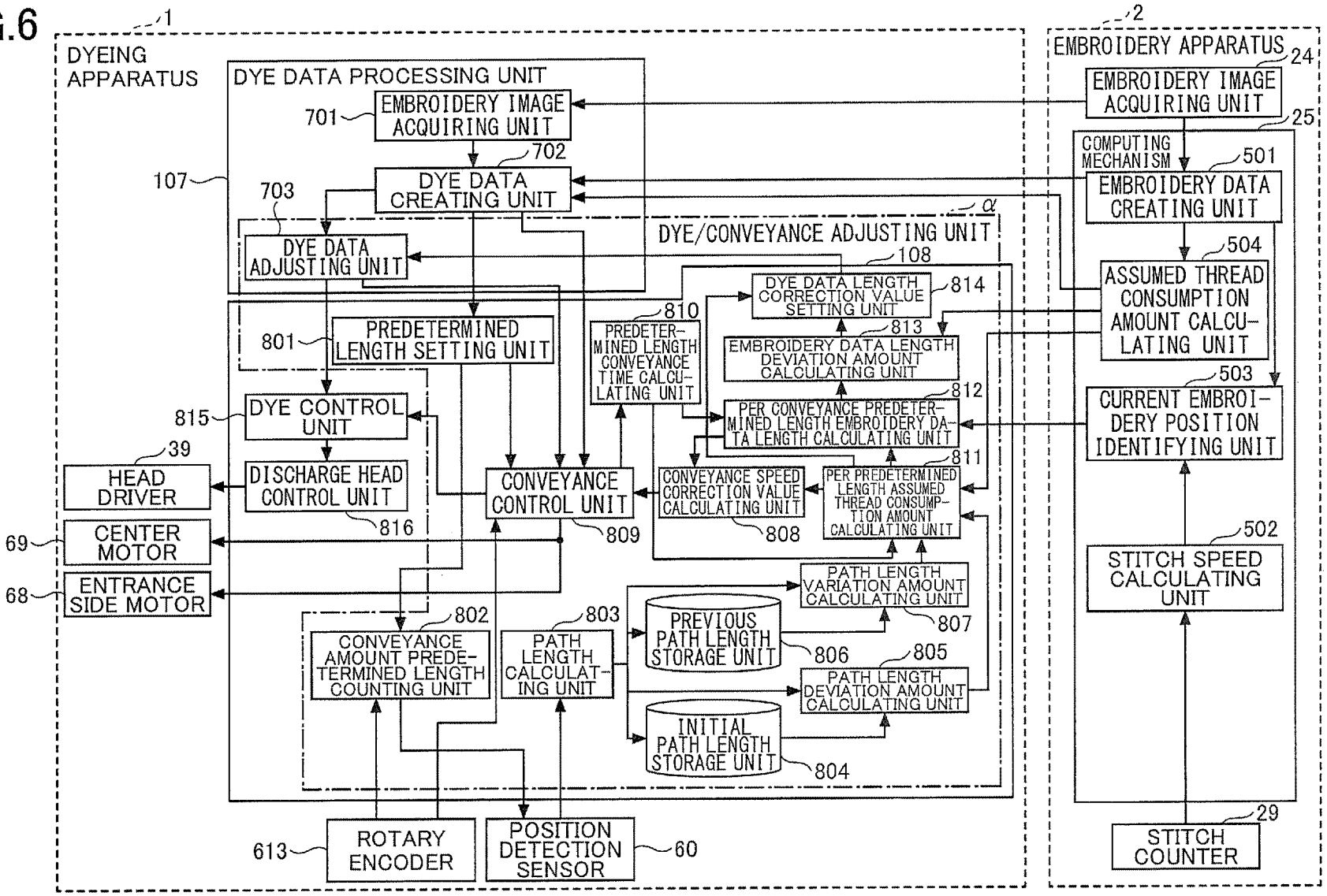
FIG. 6 is a functional block diagram of a portion relating to control in the dyeing/embroidery system in a first control example according to the first embodiment of the present invention.

Here, details of the control of dye/conveyance in FIG. 5 will be described with reference to FIG. 6. FIG. 6 is a functional block diagram illustrating the part related to the control of dye/conveyance according to a first control example of the dyeing/embroidery system 3 according to the first embodiment.

The dye data processing unit 107 of the dyeing apparatus 1 includes an embroidery image acquiring unit 701, a dye data creating unit 702, and a dye data adjusting unit 703 in an executable manner.

The computing mechanism 108 of the first control example includes a predetermined length setting unit 801, a conveyance amount predetermined length counting unit 802, a path length calculating unit 803, an initial path length storage unit 804, a path length deviation amount calculating unit 805, a previous path length storage unit 806, a path length variation amount calculating unit 807, a conveyance speed correction value calculating unit 808, a conveyance control unit 809, a predetermined length conveyance time calculating unit 810, a per predetermined length assumed thread consumption amount calculating unit 811, a per conveyance predetermined length embroidery data length calculating unit 812, an embroidery data length deviation amount calculating unit 813, a dye data length correction value setting unit 814, a dye control unit 815, and a discharge head control unit 816, in an executable manner.

The dye data adjusting unit 703 of the dye data processing unit 107, the predetermined length setting unit 801, the conveyance amount predetermined length counting unit 802, the path length calculating unit 803, the previous path length storage unit 806, the initial path length storage unit 804, the path length variation amount calculating unit 807, the path length deviation amount calculating unit 805, the conveyance speed correction value calculating unit 808, the conveyance control unit 809, the predetermined length conveyance time calculating unit 810, the per predetermined length assumed thread consumption amount calculating unit 811, the per conveyance predetermined length embroidery data length calculating unit 812, the embroidery data length deviation amount calculating unit 813, and the dye data length correction value setting unit 814 of the computing mechanism 108, function as a dye/conveyance adjusting unit α.

On the other hand, the computing mechanism 25 of the embroidery apparatus 2 includes an embroidery data creating unit 501, a stitch speed calculating unit 502, a current embroidery position identifying unit 503, and an assumed thread consumption amount calculating unit 504, in an executable manner.

In the dye data processing unit 107 of the dyeing apparatus 1, the embroidery image acquiring unit 701 communicates with the embroidery apparatus 2 to acquire the embroidery image and embroidery data.

The dye data creating unit 702 creates dye data (initial dye data) based on embroidery images and embroidery data. Specifically, the dye data creating unit 702 creates dye data including information on the blending amount of each color of KCMY used for dyeing to realize the color of thread included in the embroidery data and the dyeing continuation length of each color in the discharge head of KCMY.

The dye data adjusting unit 703 increases or decreases the data length in the dye data (the initial dye data) created by the dye data creating unit 702, according to the correction value for each detectionn timing set in the dye data length correction value setting unit 814 of the computing mechanism 108, and creates the next dye data in which the data length has been corrected. Then, the created dye data is output to the dyeing control unit 815 of the computing mechanism 108.

Further, the embroidery data creating unit 501 of the computing mechanism 25 of the embroidery apparatus 2 creates embroidery data based on the embroidery image that is the acquired image data. The embroidery data includes a pair of pieces of data relating to the coordinates to which the needle is to be moved and the content of the operation to be implemented at the corresponding coordinate position, as described above.

The stitch speed calculating unit 502 acquires, in real time, stitch data (the number of stitches) that is data representing the number of stitches progressed output from the stitch counter 29, that is, which stitch is currently being sewn, and calculates the stitch speed.

The current embroidery position identifying unit 503 is a stitch position calculating unit for calculating the stitch position in the embroidery data, and calculates the current embroidery position (stitch position) to which embroidery has progressed in the embroidery data, based on the embroidery data and the stitch data.

The assumed thread consumption amount calculating unit 504 predicts the consumption speed of the thread (assumed thread consumption amount) in the embroidery apparatus 2 based on the embroidery data at the start of embroidery.

Here, in the dyeing apparatus 1 according to the first control example in an embodiment of the present invention, the adjustment of the data length of the next dye data based on the position detection by the position detection sensor 60 and the detection thereof, is performed for each predetermined conveyance length of the thread. The predetermined conveyance length (predetermined length) of the thread that is used as a reference for performing path length detection, is set by the predetermined length setting unit 801 of the computing mechanism 108. Specifically, this predetermined conveyance length (predetermined length) to be the reference is set by dividing the length by a number according to the entire data length of the dye data (initial dye data) created by the dye data creating unit 702, so that the divided data length (reference dye data length) can be appropriately adjusted. Alternatively, the predetermined length to be the reference may be set to a length predefined in the apparatus.

The conveyance amount predetermined length counting unit 802 counts the conveyance amount by which the needle thread is conveyed, by a rotary encoder 613 provided in the inlet side nip roller 61 when the needle thread is conveyed at a set conveyance speed. The conveyance amount predetermined length counting unit 802 reports a detection timing to the position detecting sensor 60, whenever the conveyance amount of the thread conveyed by the inlet side nip roller 61 reaches the predetermined length, such that the counted conveyance amount of the needle thread becomes the predetermined length set in the predetermined length setting unit 801.

The position detecting sensor 60 detects the position of the dancer roller 65 in the vertical direction, for each predetermined conveyance length of the thread reported by the conveyance amount predetermined length counting unit 802.

The path length calculating unit 803 of the computing mechanism 108 adds the vertical position of the dancer roller 65 detected by the position detecting sensor 60 to the path length of other portions of the variable conveying path PL, to calculate the total path length of the variable conveying path PL.

The initial path length storage unit 804 stores the path length of the variable conveying path PL immediately before the start of dyeing as the initial path length. The path length deviation amount calculating unit 805 calculates a deviation amount of the detected path length of the variable conveying path PL from the initial path length at the current conveyance timing of the predetermined length of the thread.

The previous path length storage unit 806 stores the detected path length of the variable conveying path PL at the current conveyance timing of the predetermined length of the thread (detection timing), and at the next detection timing, the stored path length is referred to as the previous path length.

The path length variation amount calculating unit 807 calculates, as a path length variation amount from the previous path length, the length by which the path length of the variable conveying path PL detected at the current detection timing has changed from the path length of the variable conveying path PL detected at the previous detection timing.

The predetermined length conveyance time calculating unit 810 calculates a conveyance time during which the thread is conveyed by a predetermined length. At the initial detection timing, the conveyance time of the predetermined length is a defined value because the conveyance speed is the initial value. From the second time and onwards, based on the next (n) conveyance speed adjusted by the conveyance control unit 809 at the previous (n−1) detection timing, the time required to feed the needle thread by the defined length at the corrected conveyance speed, corresponding to the period between the current detection timing and the previous detection timing (hereinafter referred to as the adjusted conveyance time), is calculated.

The per predetermined length assumed thread consumption amount calculating unit 811 is a thread consumption amount calculating unit which calculates and invokes the assumed thread consumption amount in the embroidery apparatus between detection timings. More specifically, the per predetermined length assumed thread consumption amount calculating unit 811 calculates the assumed needle thread consumption amount (the assumed thread consumption amount on the side of the embroidery apparatus 2 while feeding the predetermined length), within the conveyance time (the adjusted conveyance time) required in the next conveyance period calculated by the predetermined length conveyance time calculating unit 810, at the current detection timing, in the assumed thread consumption amount calculated by the assumed thread consumption amount calculating unit 504 of the embroidery apparatus 2. Further, the assumed needle thread consumption amount in the current conveyance period (adjusted conveyance time) calculated at the previous detection timing, is invoked at the current detection timing, and is output to the conveyance speed correction value calculating unit 808.

The conveyance speed correction value calculating unit 808 calculates the correction value of the conveyance speed of the needle thread to be applied hereafter, based on the amount of deviation from the initial path length, the amount of variation from the previous path length, and the assumed needle thread consumption amount (the assumed thread consumption amount between the previous detection timing and the current detection timing) within the current adjusted conveyance time calculated by the per predetermined length assumed thread consumption amount calculating unit 811. In this way, the conveyance speed of the needle thread is corrected to adjust the conveyance time (adjusted conveyance time) for feeding a predetermined length of the needle thread.

While performing the dyeing, the conveyance control unit 809 sets the conveyance speed of the needle thread so to apply the correction value set by the conveyance speed correction value calculating unit 808, from the first detection timing and onwards. At the start of dyeing, the conveyance control unit 809 invokes the predicted assumed consumption amount from the embroidery data in the embroidery apparatus 2 and sets the conveyance speed (the initial value) so as to attain the conveyance amount corresponding to the assumed consumption amount. The conveyance control unit 809 drives and controls the inlet motor 68 and the center motor 69 at a set conveyance speed (initial value or corrected conveyance speed). The conveyance speed correction value calculating unit 808 and the conveyance control unit 809 function as the conveyance speed control unit.

Further, the information of the conveyance speed according to the conveyance control unit 809 is reported to the dyeing control unit 815 along with the signal information of the rotary encoder 613. The dye control unit 815 controls the discharge head control unit 816 and the head driver 39 to cause the discharge heads 30Y to 30K to discharge the dyeing liquid according to the conveyance speed, i.e., to cause the dyeing unit 103 to dye the needle thread at a dyeing speed that matches the adjusted conveyance speed.

The per conveyance predetermined length embroidery data length calculating unit 812 invokes the stitch position detected by the current embroidery position identifying unit 503 of the embroidery apparatus 2 at the current detection timing and calculates the embroidery data length used in the embroidery apparatus 2 during the current conveyance period (between the previous detection timing and the current detection timing). The embroidery data length used is also referred to as the embroidery data consumption amount and represents the degree of progress of the embroidery data.

The embroidery data length deviation amount calculating unit 813 compares the embroidery data length used in the current conveyance period calculated by the per conveyance predetermined length embroidery data length calculating unit 812 with the embroidery data length assumed in the current conveyance period in the assumed thread consumption amount calculating unit 504 of the embroidery apparatus 2 to calculate the deviation amount of the embroidery data length.

The dye data length correction value setting unit 814 sets the next dye data length correction value based on the assumed needle thread consumption amount (the assumed thread consumption amount used between the current detection timing and the next detection timing) during the current adjustment conveyance time, calculated by the per predetermined length assumed thread consumption amount calculating unit 811 and invoked, and the deviation amount of the embroidery data length calculated by the embroidery data length deviation amount calculating unit 813. Further, the dye data length correction value setting unit 814 makes a setting to perform increase/decrease corrections with respect to the first portion of the dye data length corresponding to the next predetermined length of the thread, as adjustment of the data length of the dye data used during the conveyance period until the next detection timing. The method for correcting the data length of the dye data is described in detail with FIG. 10.

The dye data adjusting unit 703 increases or decreases the dye data length corresponding to a predetermined length by the correction value set in the dye data length correction value setting unit 814, creates the dye data in which the data length is corrected, and outputs the data to the dyeing control unit 815.

The dyeing control unit 815 receives the corrected dye data from the dye data adjusting unit 703, generates discharge data for each color corresponding to the discharge heads 30Y to 30K based on the dye data, and adjusts the discharge timing according to the conveyance speed.

The head control unit 816 outputs the discharge data for each color generated by the dyeing control unit 815 at an adjusted discharge timing to drive and control the head driver 39.

The head driver 39 drives the discharge heads 30K to 30Y so as to cause each of the nozzles 31 of the discharge heads 30K to 30Y to discharge ink to the needle thread N being conveyed at a timing according to the conveyance speed.

(Flowchart)

Figure 7:
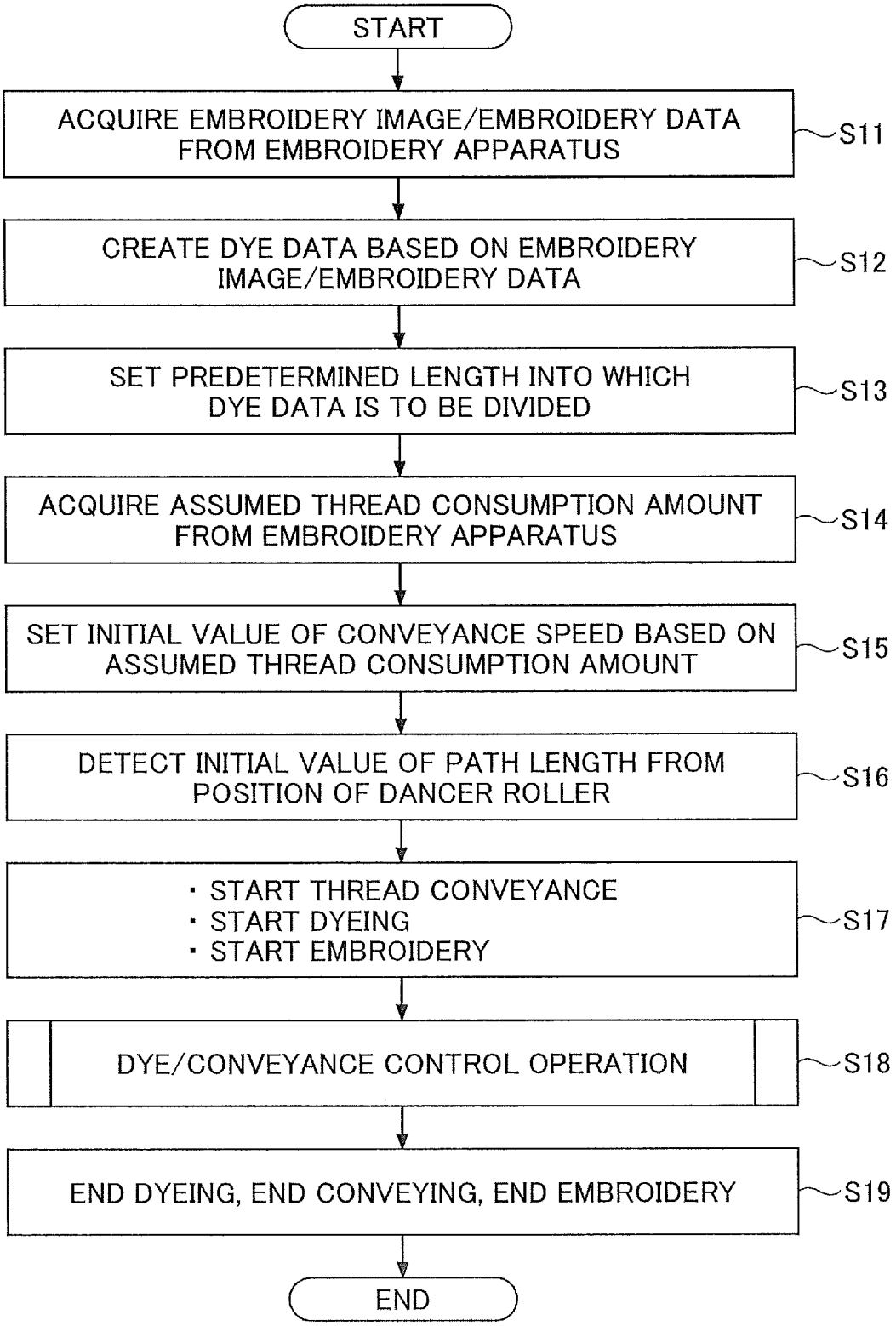
FIG. 7 is an overall flowchart of dyeing and conveyance in the first control example according to the first embodiment of the present invention.

First, the overall flow when dyeing in the dyeing apparatus 1 according to an embodiment of the present invention will be described with reference to FIG. 7. FIG. 7 is an overall flowchart of the dyeing operation according to an embodiment of the present invention.

In step S11, the dyeing apparatus 1 acquires an embroidery image and embroidery data from the embroidery apparatus 2.

In step S12, the dye data processing unit 107 creates dye data (initial dye data) based on the embroidery image and embroidery data.

In step S13, in the first control example, the computing mechanism 108 sets a predetermined length (defined length) for dividing the dye data for adjustment. This predetermined length is used to define the timing of position detection and data adjustment in the first control example.

In step S14, the dyeing apparatus 1 acquires the assumed thread consumption amount from the embroidery apparatus 2.

In step S15, the computing mechanism 108 sets the initial value of the conveyance speed based on the assumed thread consumption amount.

In step S16, the position detecting sensor 60 detects the position of the dancer roller 65, and the computing mechanism 108 calculates the path length of the variable conveying path PL based on the detected position, and stores the value as the initial value of the path length.

FIG. 7 illustrates an example in which the detection and calculation of the initial value of the path length of step S16 are performed after steps S12 to S15, but the detection and calculation of the initial value of the path length of step S16 may be performed in parallel with steps S12 to S15, or may be performed before steps S12 to S15.

In step S17, the thread conveyance starts at the initial value of the conveyance speed set in step S15, and a dyeing operation based on the dye data and an embroidery operation based on the embroidery data are started.

In step S18, control is performed during the dyeing operation. The control during the dyeing operation is described in detail with reference to FIGS. 8, 11 and 13.

In step S19, dyeing according to the entire dye data is completed, and the dye/conveyance operation and embroidery operation in the dyeing apparatus 1 are completed.

Figure 8:
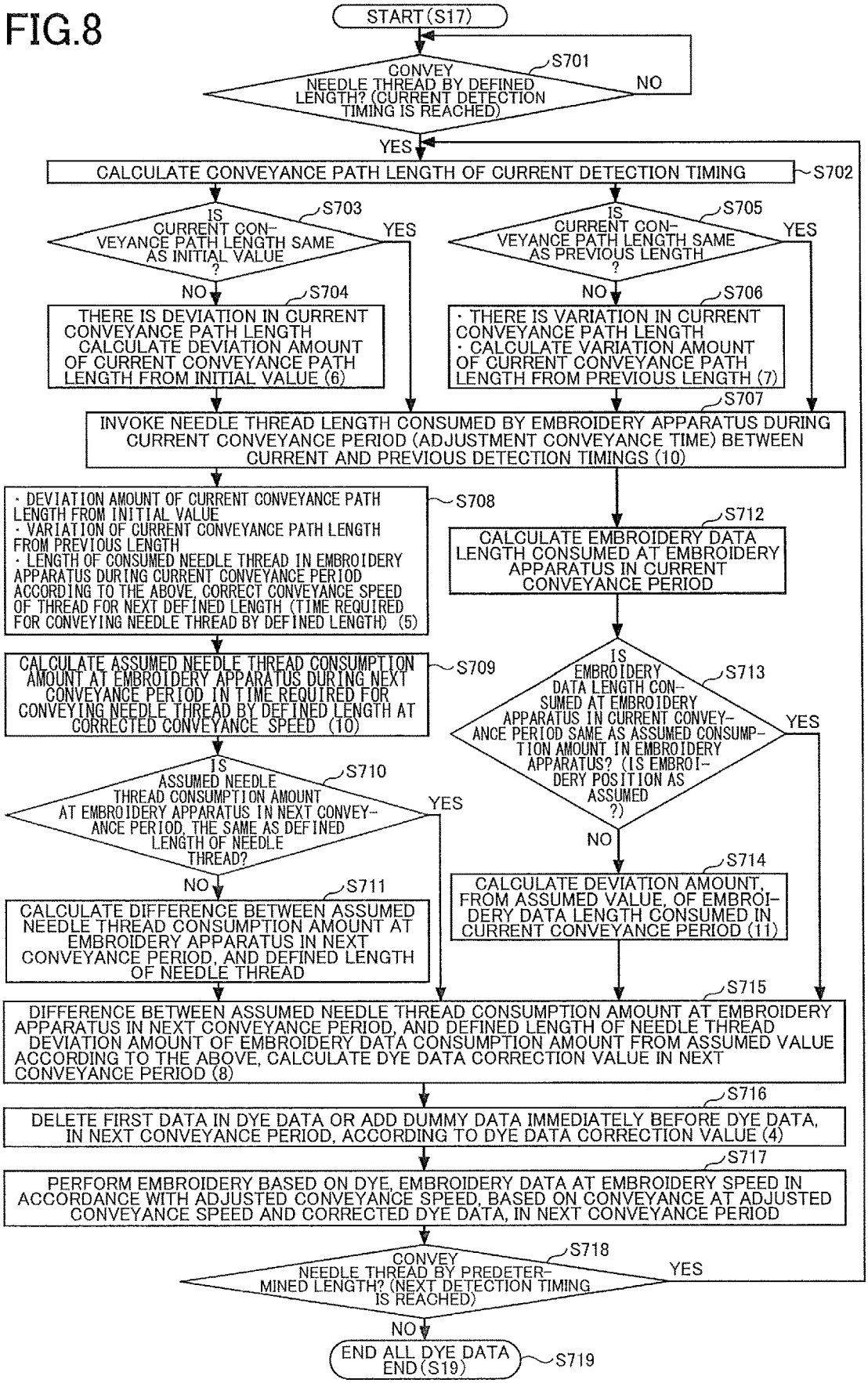
FIG. 8 is a detailed flowchart of control during a dyeing operation in the first control example according to the first embodiment of the present invention.
Figure 10A:
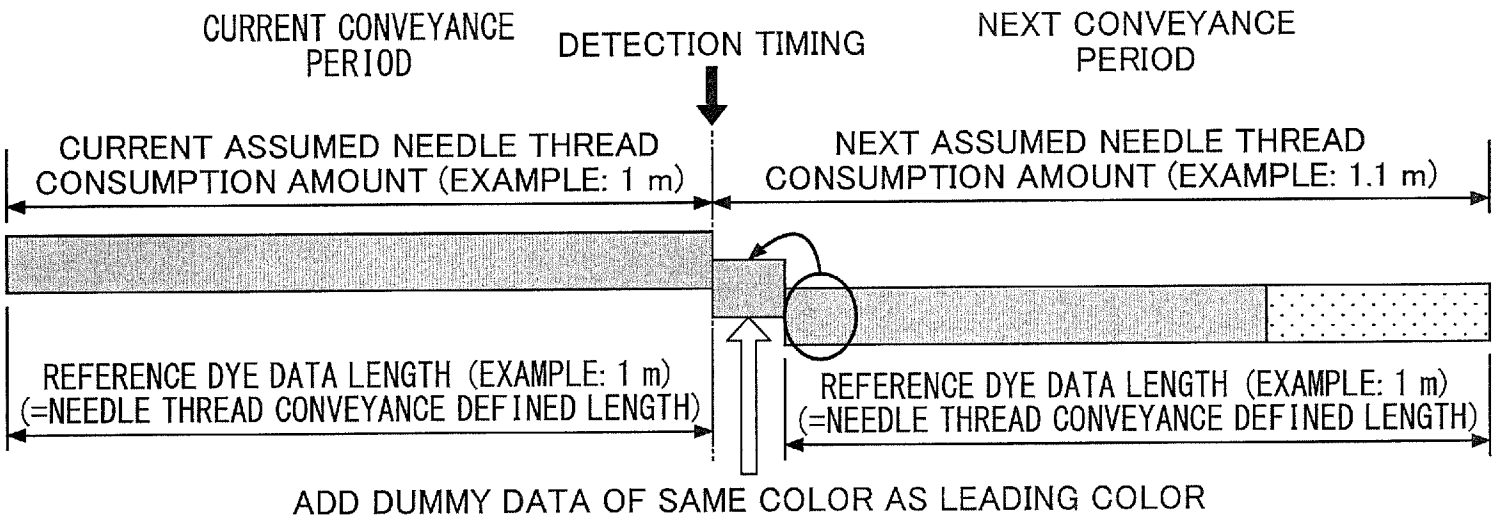
FIGS. 10A and 10B are diagrams illustrating an example of adjustment of dye data in the first control example according to the first embodiment of the present invention.
Figure 10B:
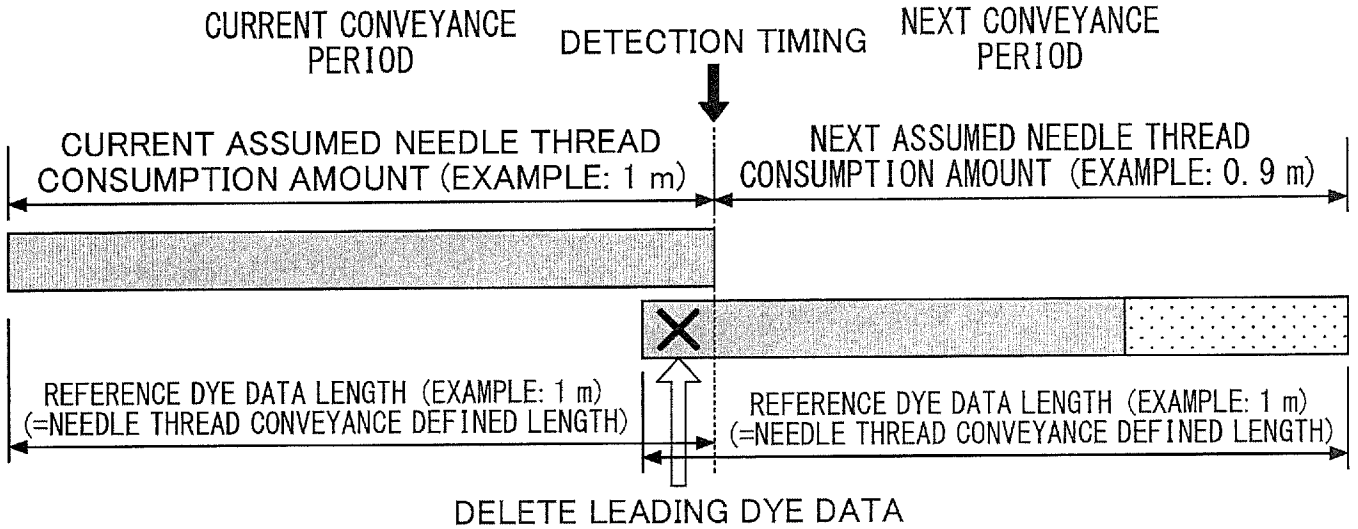

Here, the control during the dyeing operation in the first control example will be described in detail with reference to FIGS. 8 to 10B. FIG. 8 is a detailed flowchart illustrating control during a dyeing operation in the first control example according to an embodiment of the present invention. This flowchart is a detailed flowchart of step S18 of FIG. 7. FIG. 9 is a table illustrating an example of control along the flow of FIG. 8. Figures in parentheses in the flow in FIG. 8 correspond to lines in FIG. 9. FIGS. 10A and 10B is a diagram illustrating an example of adjustment of dye data.

In step S701 of FIG. 8, when the needle thread is conveyed by a predetermined length (defined length) from the time point when the conveyance starts due to the start of dyeing of step S17, it is determined that the current detection timing has been reached, and the process proceeds to step S702.

In step S702, the length of the conveying path at the current detection timing is calculated. Specifically, the position detecting sensor 60 detects the position of the dancer roller 65 and calculates the path length of the variable conveying path PL at the current detection timing.

In step S703, it is determined whether the conveying path length calculated in step S702 is the same as the initial value set in step S16 of FIG. 7. When the values are the same (YES in step S703), it is determined that there is no deviation amount between the initial value and the current conveying path length and the process proceeds to step to S707.

When the current conveying path length is different from the initial value (NO in step S703), in step S704, it is determined that the current conveying path length has deviated from the initial value, and after calculating the deviation amount of the current conveying path length from the initial value, the process proceeds to S707.

In the value of the deviation amount of the path length indicated on the sixth line of FIG. 9, a negative value means that the position of the dancer roller 65 detected by the position detecting sensor 60 has moved to an upper position from the initial value, and a positive value means that the position of the dancer roller 65 detected by the position detecting sensor 60 has moved to a lower position from the initial value.

In step S705, it is determined whether the conveying path length calculated in step S702 is the same as the conveying path length calculated at the previous detection timing. Note that, at the first detection timing, the path length calculated at the previous detection timing as the comparison target is the initial value of the conveying path length, and at the second detection timing and onwards, the path length calculated at the previous detection timing (the detection timing immediately before the current detection timing) is the comparison target. When the current path length is the same as the previous current path length (YES in step S705), it is determined that the current conveying path length has not changed from the previous conveying path length, and the process proceeds to step S707.

When the current conveying path length is different from the previous conveying path length (NO in step S705), in step S706, on the assumption that the current conveying path length has changed from the previous conveying path length, the variation amount of the current conveying path length from the previous conveying path length is calculated, and then the process proceeds to S707.

In the value of the variation amount in the path length indicated on line 7 of FIG. 9, a negative value means that the position of the dancer roller 65 detected by the position detecting sensor 60 has moved up from the previous time, and a positive value means that the position of the dancer roller 65 detected by the position detecting sensor 60 moved down from the previous time.

In step S707, the deviation amount and the variation amount of the conveying path length serve as triggers, and at the first detection timing, the length of the needle thread (the needle thread consumption amount) consumed by the embroidery apparatus 2 during the current conveyance period, conveyed at the conveyance speed of initial value, is calculated. At the second detection timing and onwards, the assumed needle thread consumption amount in the embroidery apparatus in the next conveyance period, calculated at the time of the calculation at the previous detection timing, is invoked (see step S709). Then, the length of the needle thread to be consumed by the embroidery apparatus during the current conveyance period that is calculated or invoked, is transmitted to the conveyance speed correction value calculating unit 808.

FIG. 9 illustrates an example in which the calculation or invoking of the needle thread consumption amount during the current conveyance period in step S707 is performed after steps S702 to S706. However, the calculation or invoking of the needle thread consumption amount in step S707 may be performed in parallel with steps S702 to S706 upon being triggered by the conveyance of the predetermined length of the needle thread in step S701, or may be performed before steps S702 to S706.

In step S708, the conveyance speed correction value calculating unit 808 adjusts the time required to feed the needle thread by the defined length, by correcting the conveyance speed of the thread for the defined length until the next detection timing, in accordance with the amount of deviation of the current conveying path length from the initial value calculated in step S704, the amount of variation in the current conveying path length from the previous time calculated in step S706, and the length of the needle thread to be consumed by the embroidery apparatus 2 during the current conveyance period calculated in step S707.

Here, the calculation of the correction value of the conveyance speed of the thread in step S708 will be described with reference to the table in FIG. 9 as an example. In the present control example, calculation for correction is performed each time the thread is conveyed by the predetermined length, and, therefore, the thread conveyance length until the next detection is always constant. In FIG. 9, the predetermined thread conveyance length is indicated on the first line as a reference value "10", and the reference value 10 is described below as an example.

The above-described thread conveyance speed correction value calculated in step S708 is indicated on the fifth line of the table in FIG. 9 and can be expressed by the following equation.

Thread conveyance speed correction value=[*A*]+[*B*]

[A]=Time (set value) required to feed the predetermined length=(amount of needle thread consumed by the embroidery machine (prediction value after correction)+variation amount of path length from the previous time)×variation amount of path length from the previous time

[B]=Time (set value) required to feed the predetermined length=(amount of needle thread consumed by the embroidery machine (prediction value after correction)+variation amount of path length from the previous time)×amount of deviation of path length from the initial value The deviation amount of the conveying path length from the initial value calculated in step S704, which is used for the calculation of the thread conveyance speed correction value, corresponds to the value on the sixth line in the table in FIG. 9. The variation amount of the current conveying path length from the previous time calculated in step S706 corresponds to the value on the seventh line in the table in FIG. 9. The needle thread length to be consumed by the embroidery apparatus during the current conveyance period calculated in step S707 corresponds to the value on the tenth line in the table in FIG. 9.

Therefore, the conveyance speed correction value (needle thread conveyance time correction value) set after each detection timing indicated on the fifth line of FIG. 9, is calculated by the following formula.

[(next value on line 2)/{(current value on line 10)+(current value on line 6)}×(current value on line 6)]+[(next value on line 2)/{(current value on line 10)+(current value on line6)}×(current value on line 7)].

When the value of the corrected thread conveyance speed in FIG. 9 is applied to the above calculation formula and examined, the following results are obtained.

The conveyance speed correction value set after the first detection is [12/{10+(−0.2)}×(−0.2)]+[12/{10+(−0.2)}×(−0.2)]=−0.489796.

The conveyance speed correction value set after the second detection is [8/{9+0.1}×0.1]+[8/{9+0.1}×(−0.1)]=0.

The conveyance speed correction value set after the third detection is [10/{10+0.2}×(0.2)]+[10/{10+0.2}×0.1]=0.2941176.

The conveyance speed correction value set after the fourth detection is [8/{10.5+(−0.1)}×(−0.1)]+[8/{10.5+(−0.1)}×0]=−0.076923.

The conveyance speed correction value set after the fifth detection is [12/{9.7+0.1}×(0.1)]+[12/{9.7+0.1}×0.1]=0.244898.

Referring back to FIG. 8, in step S709, the per predetermined length assumed thread consumption amount calculating unit 811 calculates the assumed needle thread consumption amount at the embroidery apparatus 2, within the next conveyance period in the time required to feed the needle thread for a defined length at the corrected conveyance speed. That is, the per predetermined length assumed thread consumption amount calculating unit 811 calculates the assumed thread consumption amount in the embroidery apparatus 2 between the current detection timing and the next detection timing of conveying the thread of a predetermined length at the conveyance speed adjusted for the next time, within the time corresponding to the adjusted conveyance speed.

In step S710, it is determined whether the assumed needle thread consumption amount of the embroidery apparatus during the next conveyance period is the same as the predetermined length of the needle thread, i.e., the predetermined dye data length. When the values are the same (YES in step S710), it is determined that the assumed needle thread consumption amount in the embroidery apparatus during the next conveyance period is the same as the defined length of the needle thread, and the process proceeds to step S715.

When the adjusted needle thread conveyance amount is different from the defined length of the needle thread (NO in step S710), the process proceeds to step S711, the difference between the assumed needle thread consumption amount in the embroidery apparatus during the next conveyance period and the defined length of the needle thread is calculated, and the process proceeds to S715.

In step S712, in parallel with steps S708 to S711, the embroidery data consumption amount at the embroidery apparatus 2 during the current conveyance period (the period during which the conveyance time corresponding to the corrected conveyance speed has elapsed) between the current detection timing and the previous detection timing is calculated. Specifically, the per conveyance predetermined length embroidery data length calculating unit 812 invokes the stitch position of the current embroidery position identifying unit 503 of the embroidery apparatus 2 at the detection timing and calculates the used embroidery data length (amount of embroidery data consumed) representing the degree of progress of the embroidery data.

In step S713, it is determined whether the length of embroidery data consumed during the current conveyance period calculated in step S712 is the same as the assumed length of embroidery data, that is, whether the embroidery position is as assumed. When the determination is as assumed, it is determined that the length of embroidery data consumed in the embroidery apparatus during the current conveyance period is as assumed, and the process proceeds to step S715.

In step S714, the embroidery data length deviation amount calculating unit 813 calculates a deviation amount of the embroidery data length consumed during the current conveyance period, which is the time between the previous detection timing and the current detection timing, from the assumed thread consumption amount (embroidery data length) in the embroidery apparatus 2. The amount of deviation of the used embroidery data length calculated in step S714 is indicated on line 11 of FIG. 9, and the amount of deviation at the initial timing is "−0.1".

In step S715, the dye data correction value in the next conveyance period is calculated according to the difference between the assumed needle thread consumption amount in the embroidery apparatus in the next conveyance period calculated in step S711 and the defined length of the needle thread, and the deviation amount of the embroidery data length calculated in step S714 from the assumed length.

The corrected value of the dye data length, calculated in step S715 above, is indicated on line 8 of the table in FIG. 9 and can be expressed by the following equation.

Dye data length correction value={(defined length)−(assumed thread consumption amount in the next adjusted conveyance time)}−(deviation of the consumed embroidery data length)

The difference between the assumed needle thread consumption amount in the embroidery apparatus during the next conveyance period calculated in step S711 and the defined length of needle thread, used in the calculation of step S715, is indicated by {(next value on line 1)−(next value on line 10)} in the table of FIG. 9, and the deviation amount from the assumption of the consumed embroidery data length calculated in step S714, corresponds to the current value on line 11 of the table of FIG. 9.

Therefore, the dye data correction value set after each detection timing illustrated on line 8 in the table in FIG. 9 is calculated by {(next value on line 1)−(next value on line 10)}−(current value on line 11).

In FIG. 9, when a dye data correction value is calculated by applying the above formula, the following results are obtained.

The dye data correction value set after the first detection is (10−9)−(−0.1)=1.1.

The dye data correction value set after the second detection is (10−10)−0=0.

The dye data correction value set after the third detection is (10−10.5)−0=−0.5.

The dye data correction value set after the fourth detection is (10−9.7)−0.2=0.1.

The dye data correction value set after the fifth detection is (10−10.1)−0=−0.1.

FIG. 9 illustrates the detection and correction of six times. Similarly, in subsequent control operations, the path length and the assumed thread consumption amount in the current adjusted conveyance time, at each detection timing, are used to correct the next conveyance speed as appropriate. The dye data length is correct as appropriate according to the assumed thread consumption amount in the next adjusted conveyance time using the conveyance speed, and the amount of deviation of the embroidery data length currently consumed.

Referring back to FIG. 8, in step S716, the correction of the dye data during the next conveyance period is applied according to the dye data correction value. Specifically, according to the dye data correction value, the first data of the dye data of the next conveyance period is deleted or dummy data is added immediately before the dye data in the next conveyance period.

Here, a method of adjusting a dye data length will be described with reference to FIGS. 10A and 10B. FIG. 10A illustrates the case where the next assumed needle thread consumption amount is longer than the needle thread conveyance defined length, and FIG. 10B illustrates the case where the next assumed needle thread consumption amount is shorter than the needle thread conveyance defined length. The next assumed needle thread consumption amount means the assumed needle thread length to be consumed by the embroidery apparatus 2 in the time (adjusted conveyance time) required to feed the needle thread by the defined length at the corrected conveyance speed, in the next time. FIGS. 10A and 10B illustrate cases in which there is no deviation of the used embroidery data length, at the current detection timing.

Here, the dyeing unit 103 performs dyeing according to the conveyance speed, and, therefore, the defined length of the needle thread=the reference dye data length, is established.

As illustrated in FIG. 10A, if the assumed needle thread consumption amount of the next time is shorter than the needle thread conveyance defined length, the dye data is added in the next conveyance period. Specifically, dummy data is added to the beginning of the dye data in the next conveyance period in which the needle thread is conveyed for the defined length at the adjusted conveyance speed. The dummy data is the same color as the first color of the next data.

On the other hand, as illustrated in FIG. 10B, when the assumed needle thread consumption amount for the next time is longer than the needle thread conveyance defined length, the dye data length is reduced in the next conveyance period. Specifically, the first data of the dye data is deleted in the next conveyance period in which the needle thread is conveyed for the defined length at the adjusted conveyance speed.

Incidentally, such correction of the dye data length is effective when the same color continues longer than a certain length (for example, longer than the needle thread conveyance defined length), rather than in a case of a dyeing operation in which two or more colors are frequently switched at short lengths.

Referring back to FIG. 8, in step S717, in the next conveyance period, conveyance is performed at the adjusted conveyance speed, dyeing is performed at the dyeing speed matched to the adjusted conveyance speed based on the corrected dye data, and embroidery is performed based on the embroidery data. At this time, according to need, to apply the control, the inlet nip roller 61 during the conveyance is conveyed at a speed to which the increase/decrease adjustment of the conveyance speed is applied, and at the dyeing unit 103, a dyeing operation is performed based on the dye data having the adjusted data length.

Then, in step S718, when the needle thread is conveyed for the defined length, that is, when the conveyance amount by the inlet side nip roller 61 reaches the next predetermined length, it is determined that the next detection timing is reached, and the process returns before step S702, and as in the current conveyance period, steps S702 to S717 are performed to adjust the conveyance speed and correct the dye data, and the adjustment and correction are applied. The dyeing, conveying, and embroidery operations are then performed in accordance with the dye data or the adjusted dye data until the dye data is completed in step S719.

In step S719, when the entire dye data is completed, the process returns to step S19 in FIG. 7 and the dyeing/conveying operation in the dyeing apparatus 1 and the embroidery operation in the embroidery apparatus 2 are ended.

Thus, in the dyeing apparatus according to the present control example, by adjusting the conveyance speed using the conveyance of the needle thread by the defined length as a trigger, it is possible to eliminate the difference in the speed between the needle thread and the bobbin thread in the embroidery apparatus, and to reduce the positional deviation of the color of the needle thread. Further, in consideration of the adjusted conveyance speed, by adjusting the dye data length for each conveyance of a predetermined length in accordance with the assumed needle thread consumption amount of the next time and the amount of deviation from the assumed embroidery data length, the shortage of dye data is supplemented and corrected while the shortage is not obviously noticeable in the embroidery, and the remaining data is rounded off and corrected. This minimizes the amount of thread color deviation in the embroidery apparatus without creating a cumulative error between the thread consumption amount on the embroidery apparatus side and the thread dyeing length.

(Second Control Example)

Figure 11:
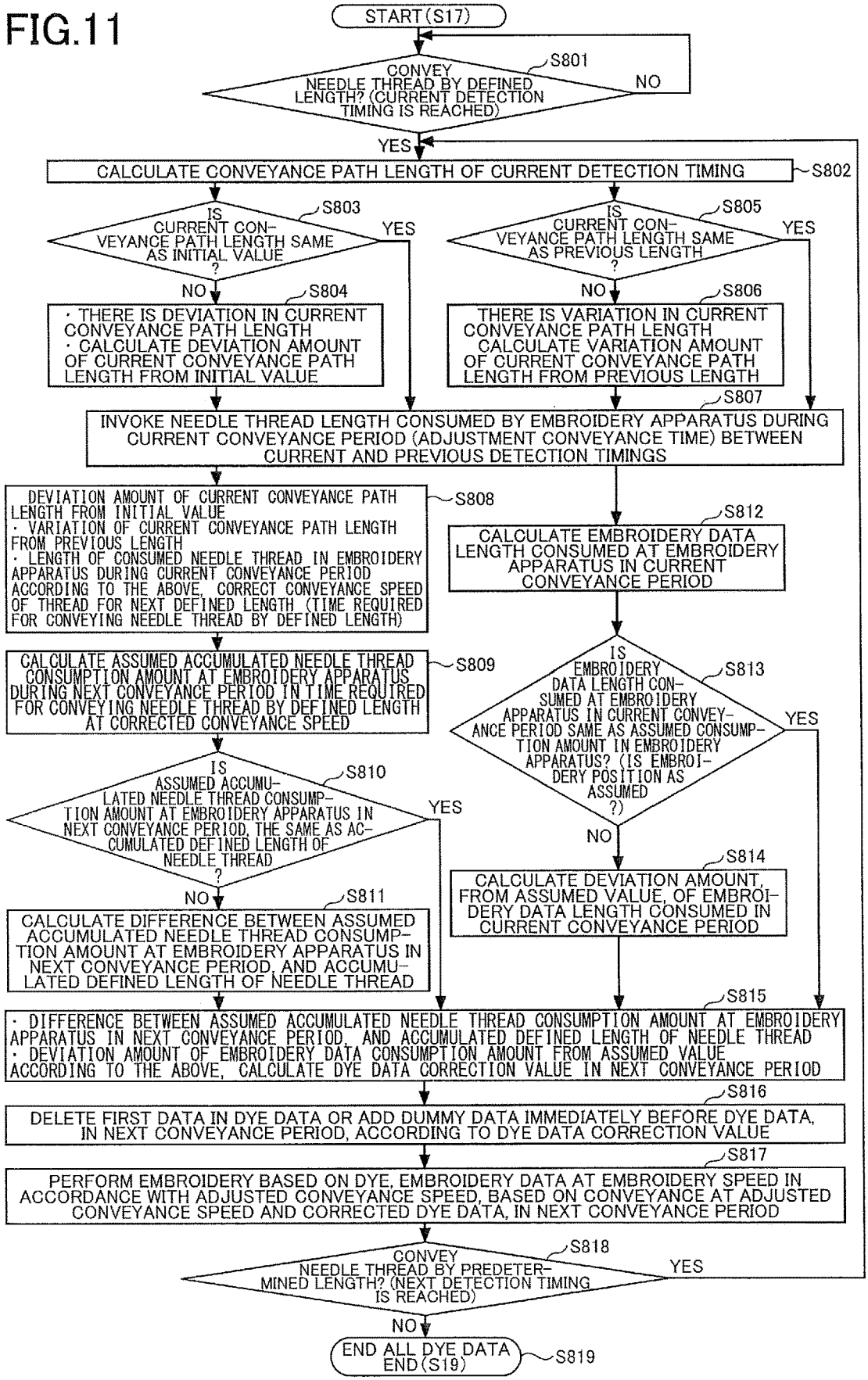
FIG. 11 is a detailed flowchart of the control during the dyeing operation in a second control example according to the first embodiment of the present invention.

FIG. 11 is a detailed flowchart illustrating control during a dyeing operation in the second control example according to an embodiment of the present invention. In the above-described first control example, the deviation amount from the needle thread conveyance defined length of the next assumed needle thread consumption amount and the deviation of the embroidery data length are used to correct the dye data length, but in the present control example, a cumulative value is used in setting the correction value of the dye data length. Only the differences from FIG. 8 will be described below.

In the present control example, in step S809, the per predetermined length assumed thread consumption amount calculating unit 811 calculates the assumed cumulative needle thread consumption amount of the embroidery apparatus by the next conveyance period in the time required to feed the needle thread for the defined length at the corrected conveyance speed. Specifically, the per predetermined length assumed thread consumption amount calculating unit 811 calculates the assumed cumulative thread consumption amount until the next detection timing. This amount is obtained by adding, to the cumulative thread consumption amount up to the current time, the assumed thread consumption amount used at the embroidery apparatus in a period between the current detection timing and the next detection timing that the thread is conveyed, at the conveyance speed adjusted for the next time, by a predetermined length for a time corresponding to the adjusted conveyance speed.

In step S810, it is determined whether the cumulative needle thread consumption amount assumed by the embroidery apparatus up to the next conveyance period is the same as the predetermined length of the accumulated needle thread, i.e., the accumulated predetermined dye data length. When the lengths are the same (YES in step S810), it is assumed that the assumed cumulative needle thread consumption amount of the embroidery apparatus 2 by the next conveying period is the same as the cumulative needle thread defined length, and the process proceeds to step S815.

When the cumulative needle thread conveyance amount up to the next time differs from the defined length of the needle thread accumulated up to the next time (NO in step S810), the process proceeds to step S811, and the difference between the assumed cumulative needle thread consumption amount of the embroidery apparatus 2 up to the next conveyance period and the defined length of the needle thread accumulated up to the next time is calculated, and the process proceeds to S815.

In step S815, the dye data correction value in the next conveyance period is calculated according to the difference between the assumed needle thread consumption amount in the embroidery apparatus 2 in the next conveyance period calculated in step S811 and the defined length of the needle thread, and the deviation amount from the assumed length of the embroidery data calculated in step S814. The subsequent flow is the same as in the first control example.

Thus, in the dyeing apparatus according to the present control example, by adjusting the conveyance speed using the conveyance of the needle thread by the defined length as a trigger, it is possible to eliminate the difference in the speed between the needle thread and the bobbin thread in the embroidery apparatus, and to reduce the positional deviation of the color of the needle thread. Further, in consideration of the adjusted conveyance speed, by adjusting the dye data length for each conveyance of a predetermined length in accordance with the cumulative assumed needle thread consumption amount up to the next time and the amount of deviation from the assumed embroidery data length, the shortage of dye data is supplemented and corrected while the shortage is not obviously noticeable in the embroidery, and the remaining data is rounded off and corrected. This minimizes the amount of thread color deviation in the embroidery apparatus without creating a cumulative error between the thread consumption amount on the embroidery apparatus side and the thread dyeing length.

(Third Control Example)

Figure 12:
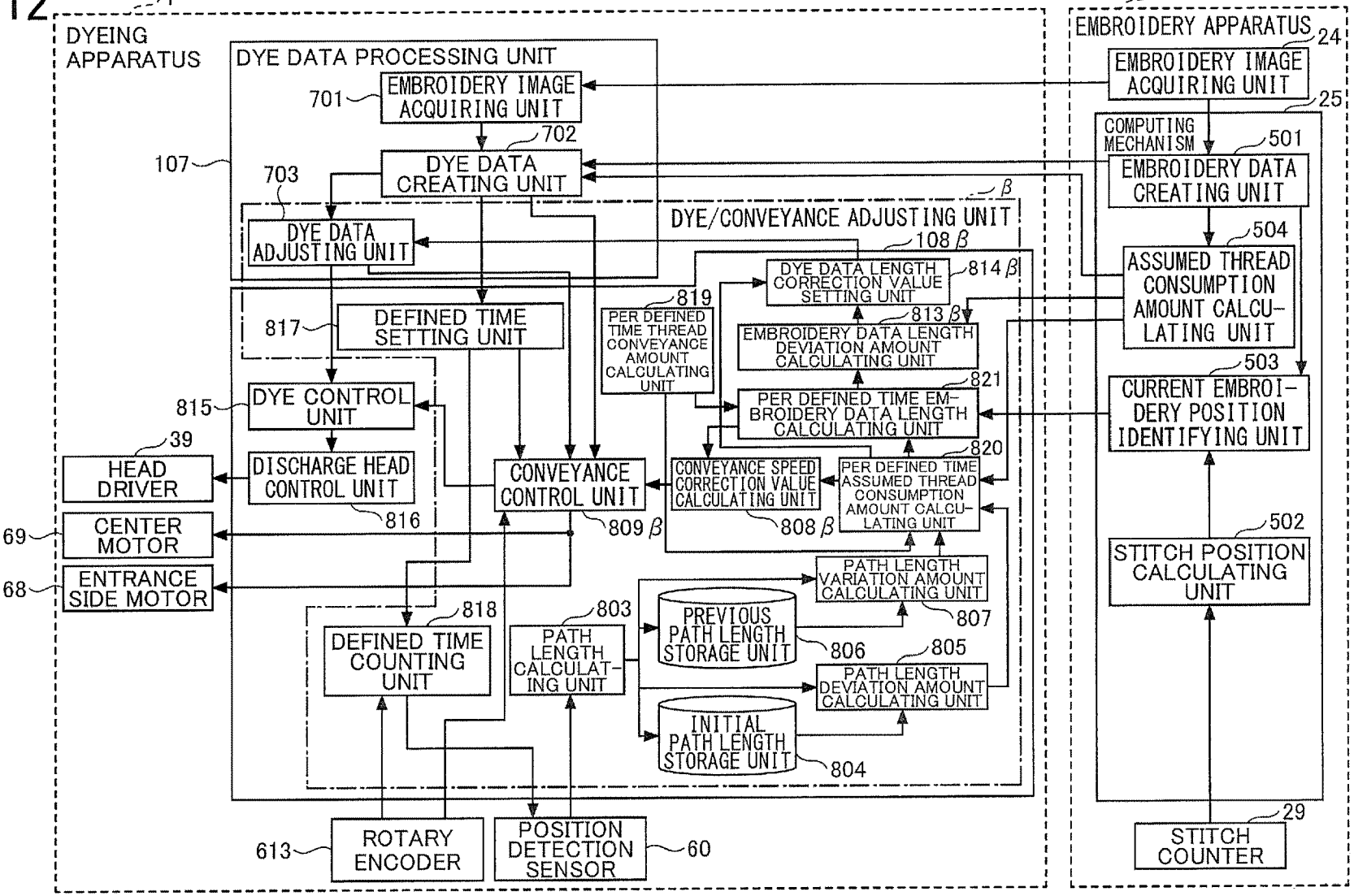
FIG. 12 is a functional block diagram of a portion relating to control of the dyeing/embroidery system in a third control example according to the first embodiment of the present invention.

FIG. 12 is a functional block diagram illustrating the control portion of the dyeing/embroidery system of the third control example according to the first embodiment. In the above-described first control example and the second control example, the detection timing is set at the time when the needle thread is conveyed for a defined length, while in the third control example, the detection timing is set at the time when a defined time has elapsed, and subsequent control is performed thereafter. Only the differences from FIG. 6 are described in the following.

A computing mechanism 108β of the second control example includes a defined time setting unit 817, a defined time counting unit 818, the path length calculating unit 803, the initial path length storage unit 804, the path length deviation amount calculating unit 805, the previous path length storage unit 806, the path length variation amount calculating unit 807, a conveyance speed correction value calculating unit 808β, a conveyance control unit 809β, a per defined time thread conveyance amount calculating unit 819, a per defined time assumed thread consumption amount calculating unit 820, a per defined time embroidery data length calculating unit 821, an embroidery data length deviation amount calculating unit 813β, a dye data length correction value setting unit 814β, the dye control unit 815, and the discharge head control unit 816, in an executable manner.

The dye data adjusting unit 703 of the dye data processing unit 107, the defined time setting unit 817, the defined time counting unit 818, the path length calculating unit 803, the initial path length storage unit 804, the path length deviation amount calculating unit 805, the previous path length storage unit 806, the path length variation amount calculating unit 807, the conveyance speed correction value calculating unit 808β, the conveyance control unit 809β, the per defined time thread conveyance amount calculating unit 819, the per defined time assumed thread consumption amount calculating unit 820, the per defined time embroidery data length calculating unit 821, the embroidery data length deviation amount calculating unit 813β, and the dye data length correction value setting unit 814β of the computing mechanism 108β function as a dye/conveyance adjusting unit 13.

In the dyeing apparatus 1 of the third control example according to an embodiment of the present invention, the adjustment of the data length of the next dye data based on the position detection by the position detection sensor 60 and the detection thereof, is performed every time a defined time approaches. The defined time which serves as the reference for executing path length detection is set by the defined time setting unit 817 of the computing mechanism 108β. Alternatively, the reference defined time may be set to a time defined in the apparatus in advance.

The defined time counting unit 818 counts the time from the time of the start of the conveyance or the previous detection timing. The defined time counting unit 818 reports to the position detecting sensor 60 that the detection timing has approached, every time the counted time reaches the defined time (predetermined time).

The position detecting sensor 60 detects the vertical position of the dancer roller 65 every time the defined time is reached. Using the detection result, the path length calculating unit 803, the initial path length storage unit 804, the path length deviation amount calculating unit 805, the previous path length storage unit 806, and the path length variation amount calculating unit 807 calculate the conveying path length for each defined time, and then calculate a deviation amount from the initial value of the conveying path length for each defined time and a variation amount from the previous value of the conveying path length for each defined time.

The per defined time thread conveyance amount calculating unit 819 calculates the thread conveyance amount at the defined time, which is the current conveyance period. The conveyance speed is an initial value at the initial detection timing, and, therefore, the thread conveyance amount per defined time is the defined value. From the second time and onwards, based on the next (nth time) conveyance speed adjusted by the conveyance control unit 809β in the previous detection timing (n−1th time), the conveyance amount (conveyance length) when the needle thread is conveyed for the defined time at the corrected conveyance speed during the current conveyance period, is calculated.

The per defined time assumed thread consumption amount calculating unit 820 calculates the assumed needle thread consumption amount (assumed thread consumption amount on the side of the embroidery apparatus 2 during the feeding of the thread for the defined time) corresponding to the conveyance amount calculated by the per defined time thread conveyance amount calculating unit 819 at the current detection timing, among the assumed thread consumption amount calculated by the assumed thread consumption amount calculating unit 504 of the embroidery apparatus 2. Further, the assumed needle thread consumption amount in the current conveyance period (defined time), which has been calculated at the previous detection timing, is invoked at the current detection timing and output to the conveyance speed correction value calculating unit 808β.

The conveyance speed correction value calculating unit 808β calculates the correction value of the conveyance speed of the needle thread to be applied hereafter, based on the amount of deviation from the initial path length, the variation amount from the previous path length, and the assumed needle thread consumption amount at the current defined time calculated by the per defined time assumed thread consumption amount calculating unit 820. Thus, in the present control example, the conveyance length of the thread to be conveyed at a defined time is adjusted by correcting the conveyance speed of the needle thread.

During dyeing, the conveyance control unit 809β sets the conveyance speed of the needle thread so as to apply the correction value set by the conveyance speed correction value calculating unit 808β at the first detection timing and onwards.

At the current detection timing, the embroidery data length calculating unit 821 invokes the stitch position of the current embroidery position identifying unit 503 of the embroidery apparatus 2 and calculates the length of the embroidery data used during the conveyance period which is the current defined time.

The embroidery data length deviation calculating unit 813β compares the embroidery data length used in the current conveyance period calculated by the embroidery data length calculating unit 821 with the embroidery data length (current embroidery position) assumed in the current conveyance period by the assumed thread consumption amount calculating unit 504 of the embroidery apparatus 2 and calculates the deviation amount of the embroidery data length.

The dye data length correction value setting unit 814 sets the next dye data length correction value, based on the deviation amount between the assumed thread consumption amount used by the embroidery apparatus 2, in the period between the current detection timing and the next detection timing in which the thread having a length corresponding to the conveyance speed adjusted for the next time calculated by the per defined time assumed thread consumption amount calculating unit 820, is conveyed at the adjusted conveyance speed for a defined time, and the embroidery data calculated by the embroidery data length deviation amount calculating unit 813β.

The dye data adjusting unit 703 increases or decreases the length of the dye data corresponding to the defined time by the correction value set by the dye data length correction value setting unit 814β, creates the dye data having the corrected data length, and outputs the data to the dyeing control unit 815. The head control unit 816 and the head driver 39 use the corrected dye data to cause the discharge heads 30K to 30Y to dye the thread at a dyeing speed that matches the conveyance speed that is adjusted at every defined time.

Figure 13:
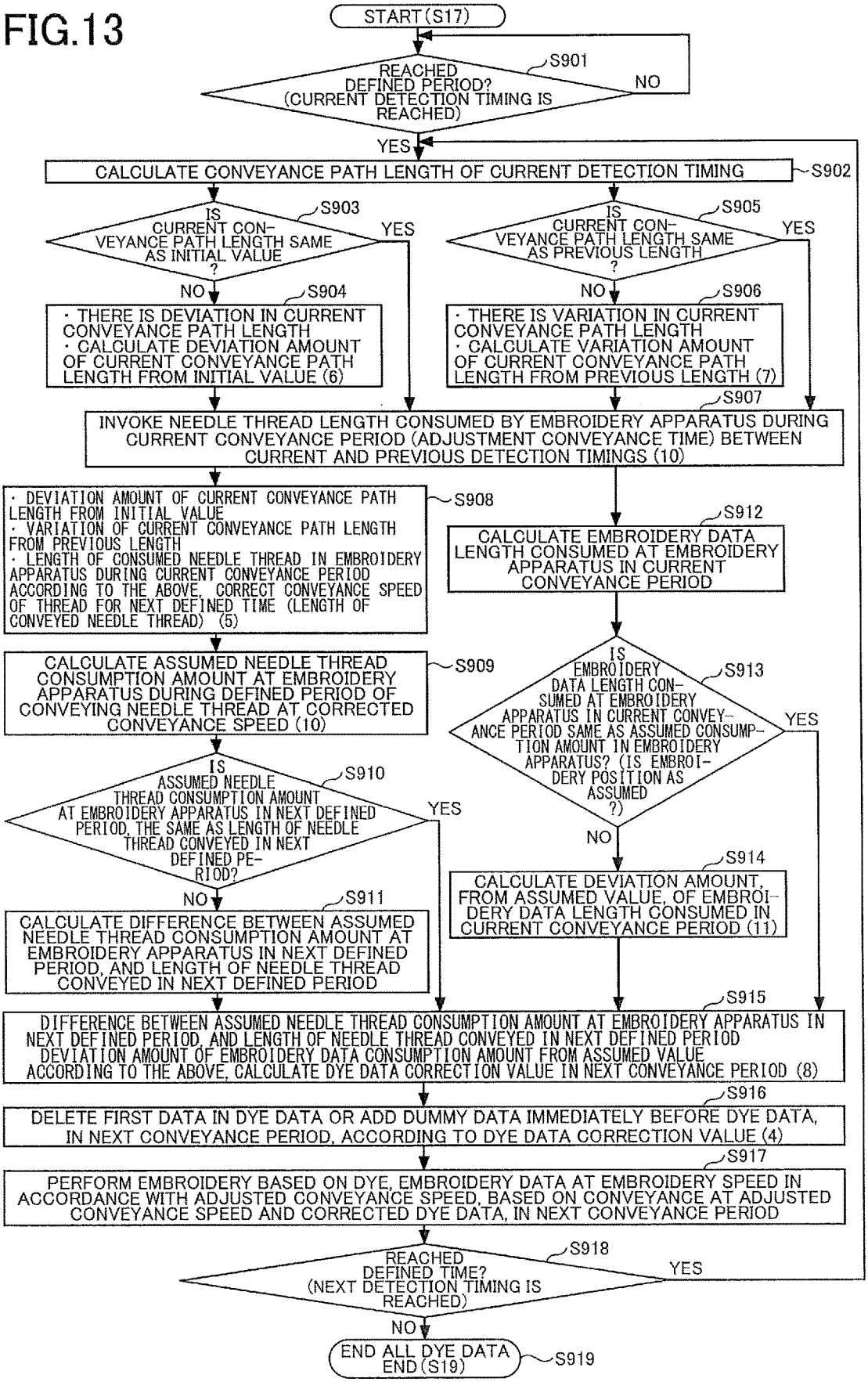
FIG. 13 is a detailed flowchart illustrating control during a dyeing operation in the third control example according to the first embodiment of the present invention.

Here, the control during the dyeing operation in the third control example will be described in detail with reference to FIGS. 13 and 14. FIG. 13 is a detailed flowchart illustrating control during the dyeing operation in the third control example according to an embodiment of the present invention. This flowchart is a detailed flowchart of step S18 of FIG. 7. FIG. 14 is a table illustrating an example of control along the flow of FIG. 13. The values in parentheses in each step of the flow in FIG. 13 correspond to the lines in FIG. 14.

In the third control example, the position of the dancer roller 65 is detected at a timing when the defined time has elapsed, and the path length is calculated. Therefore, the methods of calculating the conveyance speed and the dye data using the path length are different from the flow of FIG. 8. In the whole flow to which the detailed flow of FIG. 13 is applied, the defined time is set in FIG. 13 instead of setting the predetermined length in step S13 in FIG. 7, as preparation before the dyeing operation.

In step S901 of FIG. 13, when the thread is conveyed for a defined time from a time point when the conveyance starts by the start of dyeing in step S17, it is determined that the current detection timing is reached, and the process proceeds to step S902.

Similar to FIG. 8, the processes of steps S902 to S906 are performed to calculate the length of the conveying path, the amount of deviation of the conveying path length from the initial value, and the variation amount of the conveying path length from the previous value.

In step S907, by being triggered upon receiving the amount of deviation and the variation amount in the conveying path length, at the first detection timing, the length of the needle thread consumed by the embroidery apparatus 2 during the current conveyance period, conveyed at the conveyance speed of the initial value, is calculated. At the second detection timing and onwards, the assumed needle thread consumption amount in the embroidery apparatus, with respect to the conveyance length corresponding to the next conveyance period calculated at the time of the calculation of the previous detection timing, is invoked (see step S909). Then, the calculated or invoked length of the needle thread consumed by the embroidery apparatus during the current conveyance period, is transmitted to the conveyance speed correction value calculating unit 808β.

In step S908, the conveyance speed correction value calculating unit 808β adjusts conveyance length of needle thread conveyed in the defined time, by correcting the conveyance speed of the thread in the next defined time, according to the amount of deviation from the initial value of the current conveying path length calculated in step S904, the variation amount from the previous value of the current conveying path length calculated in step S906, and needle thread length consumed by the embroidery apparatus 2 during the current conveyance period calculated in step S907.

Here, the correction value of the conveyance length of the needle thread to be conveyed at the defined time in the present control example is calculated by the following formula.

(Thread conveyance length correction value)=(deviation amount of path length from initial value)+(variation amount of path length from previous path length)

The deviation amount from the initial value of the current conveying path length calculated in step S904 used for the calculation in step S908 corresponds to the value of the sixth line in the table in FIG. 14, and the variation amount of the current conveying path length from the previous length calculated in step S906 corresponds to the value of the seventh line in the table in FIG. 14.

Therefore, the thread conveyance length correction value set after each detection timing indicated on the fifth line in FIG. 14 is calculated by {(current value on line 6)+(current value on line 7)}.

When the value of the thread conveyance length correction value indicated on line 5 of the table in FIG. 14 is applied to the above calculation formula and examined, the following results are obtained.

The thread conveyance length correction value set after the first detection is (−0.2)+(−0.2)=−0.4.

The thread conveyance length correction value set after the second detection is (−0.1)+0.1=0.

The thread conveyance length correction value set after the third detection is 0.1+0.2=0.3.

The thread conveyance length correction value set after the fourth detection is 0+(−0.1)=−0.1.

The thread conveyance length correction value set after the fifth detection is 0.1+0.1=0.2.

Referring back to FIG. 13, in step S909, the per defined time assumed thread consumption amount calculating unit 820 calculates the assumed needle thread consumption amount (adjusted needle thread conveyance amount) of the embroidery apparatus during the next conveyance period in which the needle thread is fed for a defined time by the corrected conveyance length at the corrected conveyance speed.

In step S910, it is determined whether the assumed needle thread consumption amount of the embroidery apparatus during the next conveyance period is the same as the corrected thread conveyance length. When the values are the same (YES in step S910), it is determined that the assumed needle thread consumption amount in the embroidery apparatus in the next conveyance period is the same as the corrected conveyance length of the needle thread, and the process and proceeds to S915.

When the adjusted needle thread conveyance amount is different from the corrected needle thread conveyance length (NO in step S910), the process proceeds to step S911, and after calculating the difference between the assumed needle thread consumption amount in the embroidery apparatus during the next conveyance period and the corrected needle thread conveyance length, the process proceeds to S915.

In step S912, in parallel with steps S908 to S911, the embroidery data consumption amount in the embroidery apparatus 2 at the defined time between the current detection timing and the previous detection timing is calculated.

In step S913, it is determined whether the length of embroidery data consumed during the current conveyance period calculated in step S912 is the same as the assumed length of embroidery data (line 10 of FIG. 14), that is, whether the embroidery position is as assumed. When the embroidery position is as assumed, it is determined that the length of embroidery data consumed by the embroidery apparatus during the current conveyance period is as assumed, and the process proceeds to S915.

In step S914, the embroidery data length shift amount calculator 813β calculates the deviation amount, from the assumed thread consumption amount (embroidery data length) in the embroidery apparatus 2, of the embroidery data length consumed in the current conveyance period. The amount of deviation of the used embroidery data length calculated in step S914 is indicated on line 11 of FIG. 14, and the amount of deviation at the first timing is "−0.1".

In step S915, the dye data length correction value setting unit 814β calculates the dye data correction value in the next conveyance period in accordance with the difference between the assumed needle thread consumption amount in the embroidery apparatus 2 in the next conveyance period calculated in step S911 and the corrected conveyance length of the needle thread, and the deviation amount of the embroidery data length calculated in step S914 from the assumed amount.

The correction value of the dye data length calculated in step S915 above is indicated on line 8 of the table in FIG. 14 and can be expressed by the following equation.

Dye data correction value=(corrected thread conveyance length)−(assumed needle thread consumption amount (corrected forecast value) when conveying corrected thread conveyance length)−(deviation of data consumption amount of embroidery machine from assumption)

The (corrected thread conveyance length) used for the calculation in step S915 corresponds to the value of the third line in FIG. 14, the (assumed needle thread consumption amount (corrected prediction value) when conveying the corrected thread conveyance length) corresponds to the value of the tenth line in FIG. 14, and the (deviation of the data consumption amount of the embroidery machine from the assumption) corresponds to the value of the eleventh line in FIG. 14.

Therefore, in FIG. 14, the dye data correction value set after correction of the needle thread conveyance length after each detection timing indicated on the fifth line is calculated by (the next value of the third line)−(the next value of the tenth line)−(the current value of the 11th line))}.

When the dye data correction value indicated in the table in FIG. 14 is applied to the above calculation formula and examined, the following results are obtained.

The dye data correction value set after the first detection is 9.4−9−(−0.1)=0.5.

The dye data correction value set after the second detection is 9−9−0=0.

The dye data correction value set after the third detection is 10.7−11−0=−0.3.

The dye data correction value set after the fourth detection is 11.1−11−(0.2)=−0.5.

The dye data correction value set after the fifth detection is 10.2−10−0=0.2.

FIG. 14 illustrates the detection and correction of six times. Similarly, in the subsequent control, the next thread conveyance length is corrected as appropriate, by using the path length and the assumed thread consumption amount in the current defined time, at the detection timing of each defined time. Then, the length of the dye data is appropriately corrected according to the deviation between the assumed thread consumption amount in the next conveyance period using the thread conveyance length and the embroidery data consumption amount.

Referring back to FIG. 13, in step S916, the correction of the dye data during the next conveyance period is applied according to the dye data correction value. Specifically, depending on the dye data correction value, the first data of the dye data in the next conveyance period is deleted or the dummy data is added immediately before the dye data in the next conveyance period.

Here, the dye data length is equal to the thread conveyance length, and, therefore, in the present control example, the next dye data is increased or decreased according to the dye data correction value, with respect to the dye data of the same length as the thread conveyance length. In FIG. 14, the value obtained by adding the dye data correction value on line 8 to the next corrected thread conveyance length indicated on line 3 becomes the next corrected dye data length indicated on line 4.

In step S917, during the next conveyance period, conveyance is performed at the adjusted conveyance speed, dyeing is performed at the dyeing speed matched to the adjusted conveyance speed based on corrected dye data and embroidery is performed based on embroidery data.

Then, in step S918, when the defined time elapses from step S902, it is determined that the next detection timing is reached, and the process returns before S902, and as in the current conveyance period, steps S902 to S917 are performed to adjust the conveyance speed and correct the dye data, and the adjustment and the correction are applied. The dyeing, conveying, and embroidery operations are then performed in accordance with the dye data or the adjusted dye data until the dye data is completed in step S919.

In step S919, when the entire dye data is completed, the process returns to step S19 of FIG. 7 and the dyeing/conveying operation in the dyeing apparatus 1 and the embroidery operation in the embroidery apparatus 2 are ended.

Thus, in the dyeing apparatus according to the present control example, by calculating the path length using the defined time as a trigger and adjusting the thread conveyance length at the defined time, it is possible to eliminate the difference in the speed between the needle thread and the bobbin thread in the embroidery apparatus while reducing the positional deviation of the color of the needle thread. Further, in consideration of the adjusted conveyance speed, the length of the dye data is adjusted at each defined time according to the next assumed needle thread consumption amount and the amount of deviation of the embroidery data length from the assumption, so that a shortage of dye data is supplemented and corrected while the shortage is not obviously noticeable in the embroidery, and the remaining data is rounded off and corrected. This minimizes the amount of thread color deviation in the embroidery apparatus without creating a cumulative error between the thread consumption amount on the embroidery apparatus side and the thread dyeing length.

Second Embodiment

Figure 15:
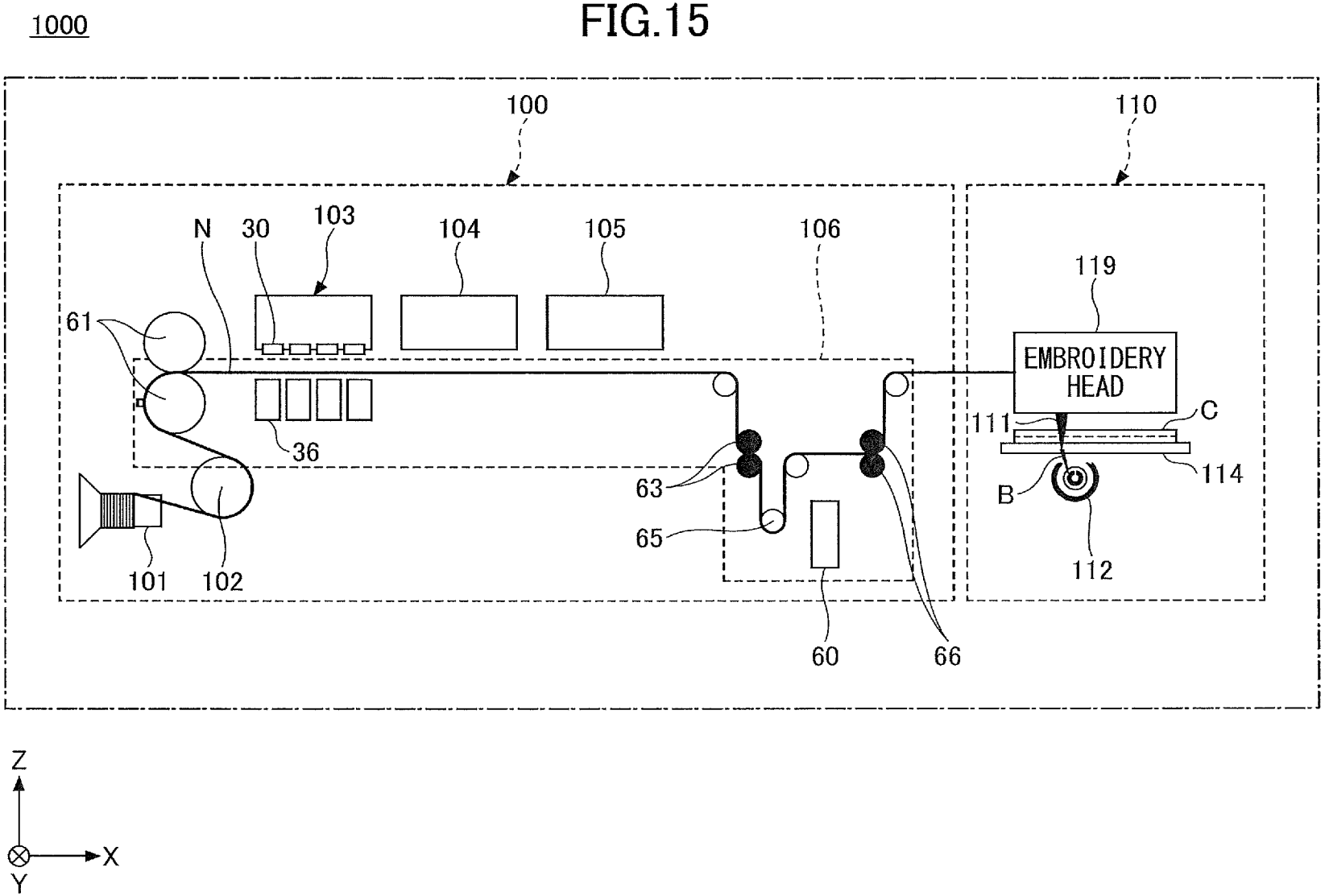
FIG. 15 is a schematic side view of an in-line type dyeing/embroidery apparatus according to a second embodiment of the present invention.

FIG. 15 is a schematic side view of an in-line type dyeing/embroidery apparatus according to a second embodiment of the present invention.

Referring to FIG. 15, a dyeing/embroidery apparatus 1000 according to the present embodiment is an in-line type dyeing/embroidery apparatus and includes a dyeing unit 100 and an embroidery unit 110.

In the present embodiment, the dyeing unit 100 and the embroidery unit 110 are provided in the same apparatus, and, therefore, the functions of the computing mechanisms 108 and 25 illustrated in FIGS. 6 and 7 can be combined into one computing device.

Third Embodiment

Figure 16:
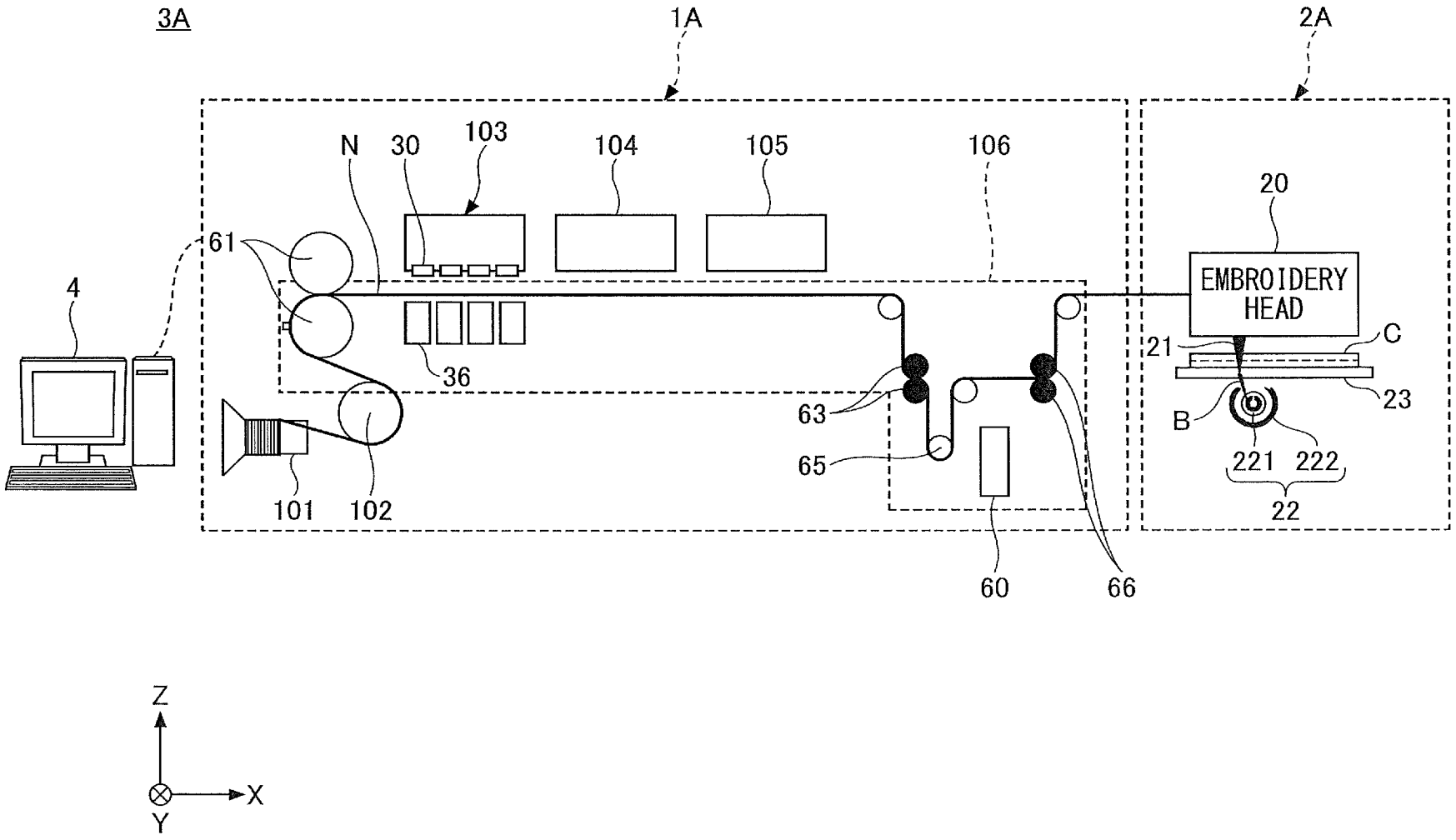
FIG. 16 is a schematic side view of a dyeing/embroidery system including a dyeing apparatus, an embroidery apparatus, and an upper level control apparatus according to a third embodiment of the present invention.

FIG. 16 is a schematic side view of a dyeing/embroidery system 3A including a dyeing apparatus, an embroidery apparatus, and an upper level control apparatus according to a third embodiment of the present invention. In the present embodiment, in addition to the configuration of the dyeing/embroidery system 3 illustrated in FIG. 1, an upper level control apparatus 4 is provided.

Figure 17:
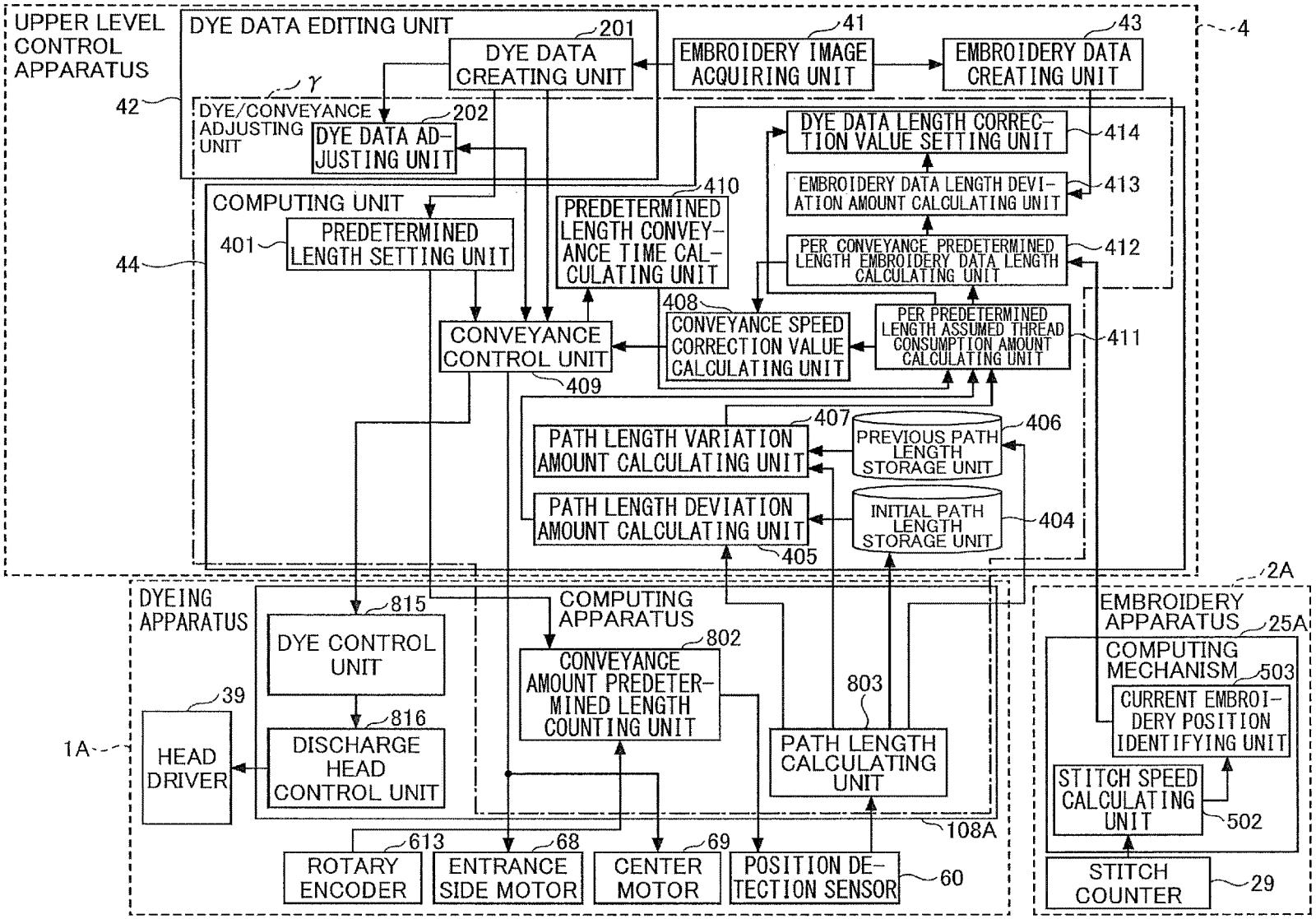
FIG. 17 is a functional block diagram of the portion related to the control of dyeing and conveyance in the dyeing/embroidery system according to the third embodiment of the present invention.

FIG. 17 is a functional block diagram illustrating the control of dyeing and conveyance in the dyeing/embroidery system 3A according to the third embodiment. In the control configuration illustrated in FIG. 17, compared to the function block illustrated in FIG. 6, the upper level control apparatus 4 performs the functions of the dye data processing unit 107 of the dyeing apparatus 1A, a part of the function of the computing mechanism 108, and a part of the computing mechanism 25 of the embroidery apparatus 2A. The members having the same names as those of FIG. 6 have the same functions, and, therefore, the descriptions thereof are omitted accordingly.

The upper level control apparatus 4 includes an embroidery image acquiring unit 41, a dye data editing unit 42, an embroidery data creating unit 43, and a computing unit 44.

For example, the embroidery image acquiring unit 41 is a communication unit that communicates with an external device, or an operation panel, and acquires an embroidery image (embroidery file) that is the source of the embroidery data, and outputs the image to the dye data editing unit 42 and the embroidery data creating unit 43.

The dye data editing unit 42 includes a dye data creating unit 201 and a dye data adjusting unit 202, and has the same function as the dye data processing unit 107 of the dyeing apparatus 1. The dye data editing unit 42 creates dye data (initial embroidery data) based on embroidery image/embroidery data, and outputs, to the dyeing control unit 815, the dye data edited to adjust the data length for each predetermined conveyance length in consideration of the path length according to a case-by-case condition.

The embroidery data creating unit 43 creates embroidery data based on the embroidery image.

The computing unit 44 includes a predetermined length setting unit 401, an initial path length storage unit 404, a path length deviation amount calculating unit 405, a previous path length storage unit 406, a path length variation amount calculating unit 407, a conveyance speed correction value calculating unit 408, a conveyance control unit 409, a predetermined length conveyance time calculating unit 410, a per predetermined length assumed thread consumption amount calculating unit 411, a per conveyance predetermined length embroidery data length calculating unit 412, an embroidery data length deviation amount calculating unit 413, and a dye data length correction value setting unit 414.

The dye data adjusting unit 202 of the dye data editing unit 42 of the upper level control apparatus 4, the predetermined length setting unit 401, the initial path length storage unit 404, the path length deviation amount calculating unit 405, the previous path length storage unit 406, the path length variation amount calculating unit 407, the conveyance speed correction value calculating unit 408, the conveyance control unit 409, the predetermined length conveyance time calculating unit 410, the per predetermined length assumed thread consumption amount calculating unit 411, the per conveyance predetermined length embroidery data length calculating unit 412, the embroidery data length deviation amount calculating unit 413, and the dye data length correction value setting unit 414 of the computing unit 44, and the conveyance amount predetermined length counting unit 802 and the path length calculating unit 803 of the dyeing apparatus 1A, function as a dye/conveyance adjusting unit γ.

In the present embodiment, the computing mechanism 108A of the dyeing apparatus 1A includes the conveyance amount predetermined length counting unit 802, the path length calculating unit 803, the dye control unit 815, and the discharge head control unit 816. The computing mechanism 25A of the embroidery apparatus 2A according to the present embodiment includes a stitch speed calculating unit and a current embroidery position identifying unit. FIG. 17 illustrates a functional block diagram of a case in which the control similar to that of the first control example is performed. However, when the control similar to the third control example is performed, a defined time setting unit, a defined time counting unit, a per defined time thread conveyance amount calculating unit, a per defined time thread consumption amount calculating unit, and a per defined time embroidery data length calculating unit are provided in the upper level control apparatus 4.

In such a dyeing/embroidery system, the upper level control apparatus 4 creates embroidery data and sends the embroidery data to the embroidery apparatus 2A. Then, the embroidery apparatus 2A sends information about the set value of the stitch speed and the position of the embroidery when the embroidery is performed, to the upper level control apparatus 4. Further, the dyeing apparatus 1A receives the dye data and the thread conveyance speed information from the upper level control apparatus 4 and transmits the dyed length and information for correcting the path length, to the upper level control apparatus 4.

In the present system, on the assumption that the path length varies in the variable conveying path PL according to the operation of the embroidery apparatus 2A, the path length is calculated using the conveyance of the predetermined length or the defined time as a trigger, the thread conveyance speed in the variable conveying path PL is adjusted, and the data length of the next dye data in the dyeing apparatus 1 is corrected. Accordingly, the amount of color deviation of the thread in the embroidery apparatus can be minimized by making corrections while the error is not obviously noticeable, without causing a cumulative error between the thread consumption amount on the embroidery apparatus side and the thread dyeing length. Accordingly, in a dyeing/embroidery apparatus capable of adjusting the path length of a thread, even when a continuous thread having a color change is used, it is possible to reduce the positional deviation of the color of embroidery on the cloth caused by the adjustment amount of the path length of the thread.

According to one embodiment of the present invention, in the dyeing apparatus, it is possible to minimize the positional deviation of the color of the needle thread while eliminating the difference in the speed between the needle thread and the bobbin thread in the embroidery apparatus without increasing the size of the apparatus, when using a continuous thread having varied colors is used in the embroidery apparatus connected to the dyeing apparatus.

The dyeing apparatus, the dyeing unit, the dyeing/embroidery system, and the adjustment method in the dyeing apparatus are not limited to the specific embodiments described in the detailed description, and variations and modifications may be made without departing from the spirit and scope of the present invention.

What is claimed is:

1. A dyeing apparatus configured to be connected to an embroidery apparatus, the dyeing apparatus comprising:

a dyer configured to dye a thread;

a conveying path in which a path length of the thread from the dyer to the embroidery apparatus is changed according to an operation of the embroidery apparatus; and circuitry configured to adjust a conveyance speed of the thread in the conveying path, according to a change in the path length, wherein the dyer dyes the thread at a dyeing speed that matches the adjusted conveyance speed, the conveying path includes an inlet nip roller provided upstream with respect to the dyer in a conveying direction of the thread, the inlet nip roller being an upstream end of the conveying path, an outlet nip roller provided adjacent to the embroidery apparatus, the outlet nip roller being a downstream end of the conveying path, and a dancer roller provided adjacent to an upstream side of the outlet nip roller and configured to be raised and lowered vertically, the inlet nip roller conveys the thread at the conveyance speed controlled by the circuitry, the outlet nip roller conveys the thread such that the thread is pulled by an amount corresponding to an amount of the thread consumed at the embroidery apparatus, the path length changes as the dancer roller is raised or lowered according to a difference between a cumulative consumption length of the thread consumed at the embroidery apparatus and a cumulative conveyance length of the thread conveyed by the inlet nip roller, and the circuitry is further configured to cause a position detector to detect a vertical position of the dancer roller in a vertical direction, calculate the path length based on the vertical position of the dancer roller, at a detection timing that approaches every time a conveyance amount of the thread conveyed by the inlet nip roller reaches a predetermined length, calculate a change amount of the path length calculated at a current detection timing from a path length calculated at a previous detection timing, calculate a deviation amount of the path length calculated at the current detection timing from a path length initial value calculated at an embroidery starting point, calculate and invoke an assumed thread consumption amount used at the embroidery apparatus between the detection timings, and adjust the conveyance speed at the inlet nip roller for a next detection timing, according to the change amount of the path length, the deviation amount of the path length from the path length initial value, and the assumed thread consumption amount used between the previous detection timing and the current detection timing.

2. The dyeing apparatus according to claim 1, wherein the dyer dyes the thread based on dye data, and the circuitry is further configured to calculate the assumed thread consumption amount used at the embroidery apparatus, between the current detection timing and the next detection timing during which the thread is conveyed for a time corresponding to the conveyance speed adjusted for the next detection timing, by the predetermined length, at the conveyance speed adjusted for the next detection timing, calculate an embroidery data length deviation amount that is a deviation amount of an embroidery data consumption amount at the embroidery apparatus from an assumed amount, between the previous detection timing and the current detection timing, and adjust a data length of the dye data used between the current detection timing and the next detection timing, according to the embroidery data length deviation amount and the assumed thread consumption amount used between the current detection timing and the next detection timing.

3. The dyeing apparatus according to claim 2, wherein the circuitry is further configured to delete first data in the dye data of a next period, when increasing the data length of the dye data, and add dummy data immediately before the dye data of the next period, when decreasing the data length of the dye data.

4. The dyeing apparatus according to claim 1, wherein the dyer dyes the thread based on dye data, and the circuitry is further configured to calculate an assumed cumulative thread consumption amount until the next detection timing, obtained by adding, to a cumulative thread consumption amount up to the current detection timing, the assumed thread consumption amount used at the embroidery apparatus, between the current detection timing and the next detection timing during which the thread is conveyed for a time corresponding to the conveyance speed adjusted for the next detection timing, by the predetermined length, at the conveyance speed adjusted for the next detection timing, calculate an embroidery data length deviation amount that is a deviation amount of an embroidery data consumption amount at the embroidery apparatus from an assumed amount, between the previous detection timing and the current detection timing, and adjust a data length of the dye data used between the current detection timing and the next detection timing, according to the embroidery data length deviation amount and the assumed cumulative thread consumption amount up to the next detection timing.

5. The dyeing apparatus according to claim 1, wherein the circuitry is further configured to calculate the path length based on the vertical position of the dancer roller detected by the position detector, at a detection timing that approaches every time a predetermined time approaches, calculate a change amount of the path length calculated at a current detection timing from a path length calculated at a previous detection timing, calculate a deviation amount of the path length calculated at the current detection timing from a path length initial value calculated at an embroidery starting point, calculate and invoke an assumed thread consumption amount used at the embroidery apparatus between the detection timings, and adjust the conveyance speed at the inlet nip roller for a next detection timing, according to the change amount of the path length, the deviation amount of the path length from the path length initial value, and the assumed thread consumption amount used between the previous detection timing and the current detection timing.

6. The dyeing apparatus according to claim 5, wherein the dyer dyes the thread based on dye data, and the circuitry is further configured to calculate the assumed thread consumption amount used at the embroidery apparatus, between the current detection timing and the next detection timing during which the thread is conveyed by a length corresponding to the conveyance speed adjusted for the next detection timing, for the predetermined time, at the conveyance speed adjusted for the next detection timing, calculate an embroidery data length deviation amount that is a deviation amount of an embroidery data consumption amount at the embroidery apparatus from an assumed amount, between the previous detection timing and the current detection timing, and adjust a data length of the dye data used between the current detection timing and the next detection timing, according to the embroidery data length deviation amount and the assumed thread consumption amount used between the current detection timing and the next detection timing.

7. A dyeing unit configured to be connected to an embroidery unit, the dyeing unit comprising:

a dyer configured to dye a thread;

a conveying path in which a path length of the thread from the dyer to the embroidery unit is changed according to an operation of the embroidery unit; and circuitry configured to adjust a conveyance speed of the thread in the conveying path, according to a change in the path length, wherein the dyer dyes the thread at a dyeing speed that matches the adjusted conveyance speed, the conveying path includes an inlet nip roller provided upstream with respect to the dyer in a conveying direction of the thread, the inlet nip roller being an upstream end of the conveying path, an outlet nip roller provided adjacent to the embroidery apparatus, the outlet nip roller being a downstream end of the conveying path, and a dancer roller provided adjacent to an upstream side of the outlet nip roller and configured to be raised and lowered vertically, the inlet nip roller conveys the thread at the conveyance speed controlled by the circuitry, the outlet nip roller conveys the thread such that the thread is pulled by an amount corresponding to an amount of the thread consumed at the embroidery apparatus, the path length changes as the dancer roller is raised or lowered according to a difference between a cumulative consumption length of the thread consumed at the embroidery apparatus and a cumulative conveyance length of the thread conveyed by the inlet nip roller, and the circuitry is further configured to cause a position detector to detect a vertical position of the dancer roller in a vertical direction, calculate the path length based on the vertical position of the dancer roller, at a detection timing that approaches every time a conveyance amount of the thread conveyed by the inlet nip roller reaches a predetermined length, calculate a change amount of the path length calculated at a current detection timing from a path length calculated at a previous detection timing, calculate a deviation amount of the path length calculated at the current detection timing from a path length initial value calculated at an embroidery starting point, calculate and invoke an assumed thread consumption amount used at the embroidery apparatus between the detection timings, and adjust the conveyance speed at the inlet nip roller for a next detection timing, according to the change amount of the path length, the deviation amount of the path length from the path length initial value, and the assumed thread consumption amount used between the previous detection timing and the current detection timing.

8. A dyeing/embroidery system comprising:

a dyeing apparatus configured to dye a thread; and an embroidery apparatus configured to perform embroidery on a cloth using the thread fed from the dyeing apparatus, wherein the dyeing apparatus includes:

a dyer configured to dye the thread;

a conveying path in which a path length of the thread from the dyer to the embroidery apparatus is changed according to an operation of the embroidery apparatus; and circuitry configured to adjust a conveyance speed of the thread in the conveying path according to a change in the path length, wherein the dyer dyes the thread at a dyeing speed that matches the adjusted conveyance speed, the conveying path includes an inlet nip roller provided upstream with respect to the dyer in a conveying direction of the thread, the inlet nip roller being an upstream end of the conveying path, an outlet nip roller provided adjacent to the embroidery apparatus, the outlet nip roller being a downstream end of the conveying path, and a dancer roller provided adjacent to an upstream side of the outlet nip roller and configured to be raised and lowered vertically, the inlet nip roller conveys the thread at the conveyance speed controlled by the circuitry, the outlet nip roller conveys the thread such that the thread is pulled by an amount corresponding to an amount of the thread consumed at the embroidery apparatus, the path length changes as the dancer roller is raised or lowered according to a difference between a cumulative consumption length of the thread consumed at the embroidery apparatus and a cumulative conveyance length of the thread conveyed by the inlet nip roller, and the circuitry is further configured to cause a position detector to detect a vertical position of the dancer roller in a vertical direction, calculate the path length based on the vertical position of the dancer roller, at a detection timing that approaches every time a conveyance amount of the thread conveyed by the inlet nip roller reaches a predetermined length, calculate a change amount of the path length calculated at a current detection timing from a path length calculated at a previous detection timing, calculate a deviation amount of the path length calculated at the current detection timing from a path length initial value calculated at an embroidery starting point, calculate and invoke an assumed thread consumption amount used at the embroidery apparatus between the detection timings, and adjust the conveyance speed at the inlet nip roller for a next detection timing, according to the change amount of the path length, the deviation amount of the path length from the path length initial value, and the assumed thread consumption amount used between the previous detection timing and the current detection timing.

9. An adjustment method performed in a dyeing apparatus configured to be connected to an embroidery apparatus, the dyeing apparatus including:

a dyer configured to dye a thread; and a conveying path in which a path length of the thread from the dyer to the embroidery apparatus is changed according to an operation of the embroidery apparatus, the conveying path including an inlet nip roller provided upstream with respect to the dyer in a conveying direction of the thread, the inlet nip roller being an upstream end of the conveying path, an outlet nip roller provided adjacent to the embroidery apparatus, the outlet nip roller being a downstream end of the conveying path, and a dancer roller provided adjacent to an upstream side of the outlet nip roller and configured to be raised and lowered vertically, the inlet nip roller conveying the thread at the conveyance speed, the outlet nip roller conveying the thread such that the thread is pulled by an amount corresponding to an amount of the thread consumed at the embroidery apparatus, the path length changing as the dancer roller is raised or lowered according to a difference between a cumulative consumption length of the thread consumed at the embroidery apparatus and a cumulative conveyance length of the thread conveyed by the inlet nip roller, the adjustment method comprising:

detecting the path length every time the thread is conveyed by a predetermined length or every time a predetermined time approaches;

adjusting a conveyance speed of the thread in the conveying path, according to a change in the path length;

dyeing, by the dyer, the thread at a dyeing speed that matches the adjusted conveyance speed, detecting a vertical position of the dancer roller in a vertical direction, calculating the path length based on the vertical position of the dancer roller, at a detection timing that approaches every time a conveyance amount of the thread conveyed by the inlet nip roller reaches a predetermined length, calculating a change amount of the path length calculated at a current detection timing from a path length calculated at a previous detection timing, calculating a deviation amount of the path length calculated at the current detection timing from a path length initial value calculated at an embroidery starting point, calculating and invoking an assumed thread consumption amount used at the embroidery apparatus between the detection timings, and adjusting the conveyance speed at the inlet nip roller for a next detection timing, according to the change amount of the path length, the deviation amount of the path length from the path length initial value, and the assumed thread consumption amount used between the previous detection timing and the current detection timing.

* * * * *